US007980504B2

(12) United States Patent
Butterworth

(10) Patent No.: US 7,980,504 B2
(45) Date of Patent: Jul. 19, 2011

(54) AUTOMATED UNWIND SYSTEM WITH AUTO-SPLICE

(75) Inventor: Tad T. Butterworth, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 0 days.

(21) Appl. No.: 12/761,529

(22) Filed: Apr. 16, 2010

(65) Prior Publication Data

US 2010/0264248 A1 Oct. 21, 2010

Related U.S. Application Data

(60) Provisional application No. 61/170,449, filed on Apr. 17, 2009.

(51) Int. Cl.
*B65H 21/00* (2006.01)

(52) U.S. Cl. ..... 242/554; 242/554.3; 242/555; 242/555.3; 242/556.1

(58) Field of Classification Search ..... 242/552, 242/554, 544.3, 555, 555.1–555.3, 555.5–555.7, 242/556, 556.1
See application file for complete search history.

(56) References Cited

U.S. PATENT DOCUMENTS

| | | | | |
|---|---|---|---|---|
| 3,813,053 | A * | 5/1974 | Butler et al. | 242/412.3 |
| 4,233,104 | A | 11/1980 | Fujishima et al. | |
| 4,443,291 | A | 4/1984 | Reed | |
| 4,455,190 | A | 6/1984 | Bianchetto et al. | |
| 4,543,152 | A | 9/1985 | Nozaka | |
| 4,564,150 | A | 1/1986 | Keene et al. | |
| 4,769,098 | A | 9/1988 | Cederholm et al. | |
| 4,859,270 | A | 8/1989 | Martin et al. | |
| 4,923,546 | A | 5/1990 | Wheeler et al. | |
| 4,948,060 | A | 8/1990 | Kurz et al. | |
| 5,169,082 | A * | 12/1992 | da Silva et al. | 242/556 |
| 5,190,234 | A | 3/1993 | Ezekiel | |
| 5,253,819 | A | 10/1993 | Butler, Jr. | |
| 5,385,316 | A * | 1/1995 | Weis | 242/552 |
| 5,709,355 | A * | 1/1998 | Kinnunen et al. | 242/555.3 |
| 6,079,661 | A | 6/2000 | Klimek et al. | |
| 6,355,139 | B1 | 3/2002 | Baggot et al. | |
| 6,533,212 | B1 | 3/2003 | Tafel, II | |
| 6,629,664 | B2 | 10/2003 | Weijenborg | |
| 6,817,566 | B2 | 11/2004 | Clifford et al. | |
| 6,820,836 | B2 | 11/2004 | Sato et al. | |

(Continued)

FOREIGN PATENT DOCUMENTS

| | | | |
|---|---|---|---|
| EP | 1 340 702 | A1 | 1/1999 |
| JP | 2002-087665 | A | 3/2002 |
| JP | 2004-073201 | A | 3/2004 |
| JP | 2005-200197 | A | 7/2005 |
| KR | 10-0185 655 | B1 | 4/1999 |
| KR | 10-1999-0072462 | A | 9/1999 |

*Primary Examiner* — Sang Kim

(74) *Attorney, Agent, or Firm* — Reinhart Boerner Van Deuren P.C.

(57) ABSTRACT

A splice is made, between a tail end of first web and a lead end of a second web coiled about an unwind axis, by winding a portion of the first web adjacent the tail end of the first web about a splicing roll mounted for rotation about a splice roll axis oriented substantially parallel to the unwind axis, and then joining the tail end to the lead end by compressing an adhesive between an inside surface of the tail end and an outer surface of the second web. Compression of the adhesive is accomplished by urging the splice roll against the coiled second web while the coiled second web is rotating about the unwind axis in an unwind direction and the splicing roll is rolling about the splice roll axis in a direction opposite to the unwind direction.

51 Claims, 19 Drawing Sheets

U.S. PATENT DOCUMENTS 6,923,880 B2 8/2005 Keene et al.
7,128,795 B2 10/2006 Byrne et al.
7,306,184 B2 12/2007 Tafel
2005/0241774 A1 11/2005 Hart et al.

* cited by examiner

AUTOMATED UNWIND SYSTEM WITH AUTO-SPLICE

CROSS-REFERENCE TO RELATED PATENT APPLICATIONS

This patent application claims the benefit of U.S. Provisional Patent Application No. 61/170,449, filed Apr. 17, 2009, the disclosure and teachings of which are incorporated herein, in their entireties, by reference.

FIELD OF THE INVENTION

This invention relates to a method and apparatus for feeding a continuous web of paper or like material into a rotary press, folding machine, or other machine. More specifically, the invention relates to a method and apparatus for automated splicing of successive rolls of the web either with or without the need for suspending the feeding of the web along the feed path.

BACKGROUND OF THE INVENTION

Many types of flexible materials such as paper, plastic and fabric are coiled into rolls and shipped to an end-user or processor. Typically, the coiled material is mounted on an unwind stand which allows the web of material to be unwound in a controlled fashion so that it can be converted into a finished product. When one roll of material is consumed, the exhausted roll is removed from the unwind stand and a new roll mounted so that the processing operation can resume.

Generally, the new roll of material is mounted in proximity to the old roll, prior to expiration of the old roll, so that the lead end of the web on the new roll can be spliced to the tail end of the web on the old roll. When the old roll is nearly exhausted, the splice is formed either manually, or through an automated process.

Although forming the splice through a manual process generally is the simplest approach, and avoids the need for complicated automated splicing and roll handling equipment, manual splicing is often undesirable because the flow of the web of material along the feed path must be stopped during the roll changing and splicing process.

Through the years, a wide variety of approaches to providing automated splicing and roll changing have been proposed and utilized. Generally, however, these prior approaches have been more complex and costly than is desirable.

Accordingly, it is desirable to provide an improved method and apparatus for replacing and expiring roll of web material with a fresh roll of web material, and for forming an automated splice between the tail end of the web from the expiring roll and the lead end of the web from the new roll. It is further desirable that such an improved method and apparatus be capable of forming a splice while the web of material is being continuously fed along the feed path, or alternatively while the web is not being fed along the feed path.

BRIEF SUMMARY OF THE INVENTION

The invention provides an improved method and apparatus for splicing a tail end of a first web, extending along a web feeding path from an exhausted first roll, to a lead end of a second web coiled in a winding direction about an unwind axis into a second roll. The splice is made by winding a portion of the first web adjacent the tail end of the first web about a splicing roll mounted for rotation about a splice roll axis oriented substantially parallel to the unwind axis, and then joining the tail end to the lead end by compressing an adhesive between an inside surface of the tail end and an outer surface of the second web. Compression of the adhesive is accomplished by urging the splice roll against the coiled second web while the coiled second web is rotating about the unwind axis in an unwind direction and the splicing roll is rolling about the splice roll axis in a direction opposite to the unwind direction.

Those having skill in the art will recognize that forming a splice, in accordance with the invention, through rolling contact of the splice roll with the outer surface of the second coil in such a manner that the portion of the tail end of the first web is directed across the adhesive is an elegantly simple approach to forming the splice. Having a length of the tail end of the first web available to be dispensed during the rolling contact as the splice is made precludes the need for precise placement and positioning of the tail end, the lead end and the adhesive, thereby allowing methods and apparatuses according to the invention to be considerably less complex and more reliable than those required in prior approaches.

In one form of the invention, a method is provided for splicing a tail end of a first web to the lead end of a second web. The first web has an uncoiled section thereof extending in an out-feed direction along a web path from a coiled section thereof which is coiled in a winding direction opposite the out-feed direction about an unwind axis into a first coil. The second web is coiled in the winding direction about the unwind axis into a second coil. Both the first and second webs define respective outer and inner surfaces thereof, and the outer surfaces of respective outer layers of the first and second webs of each of the first and second coils define respective outer surfaces of each of the first and second coils.

A portion of the uncoiled section of the first web adjacent the tail end of the first web is wound about a splicing roll. The splicing roll is mounted for rotation about a splice roll axis oriented substantially parallel to the unwind axis. The outer surface of the portion of the uncoiled section adjacent the tail end of the first web is attached to the splice roll, and the splice roll is rotated about the splice roll axis in a direction opposite the winding direction of the coils, to wind the portion of the uncoiled section of the first web adjacent the tail end of the first web about the splicing roll.

The tail end of the first coil is then joined to the lead end of the second coil through compressing an adhesive between inside surface of the tail end of the first coil and the outer surface of the second coil, by urging the splice roll against the second coil while the second coil is rotating about the unwind axis in the unwind direction, and while the splicing roll is rolling about the splice roll axis in a direction opposite to the unwind direction.

An apparatus or method, according to the invention, may include provisions for manually or automatically apply and activate an adhesive between faying surfaces of the tail end of the first coil and the lead end of the second coil. It is contemplated that, within the scope of the invention, a wide variety of adhesives, splicing apparatuses and splicing methods may be applied with efficacy in various embodiments of the invention.

In some forms of the invention, a pressure sensitive adhesive may be particularly suitable for use in forming the splice, with the pressure sensitive adhesive being applied in a variety of forms by various appropriate methods and apparatuses. For example, in some embodiments of the invention, it is contemplated that a strip of double-sided, pressure-sensitive tape may be manually or automatically applied between faying surfaces of the tail end of the first coil and the lead end of the second coil. In other embodiments of the invention, it is contemplated that a pattern of pressure-sensitive adhesive may be manually or automatically applied between faying surfaces of the tail end of the first coil and the lead end of the second coil by spraying the pressure sensitive adhesive onto one or both of the faying surfaces.

A method, according to the invention, may also include applying a pressure-sensitive adhesive to the outer surface of the second web adjacent to and upstream from the lead end of the second web. The pressure sensitive adhesive may be applied by a variety of manual and automated methods, according to the invention, including applying a double-sided tape, or spraying the adhesive, onto one or both of the faying surfaces of the tail end of the first web and/or the lead end of the second web. A method may also include orienting the second coil bout the unwind axis to place the lead end of the second web in a predetermined pre-splicing position about the unwind axis.

In some forms of the invention, the portion of the uncoiled section wound about the splice roll is pulled back along the web path in a direction opposite to the out-feed direction by rotating the splicing roll about the splice roll axis in the direction opposite to the winding direction of the coils about the unwind axis. The uncoiled section of the first web may be continually fed along the web path in the out-feed direction while splicing the tail end of the first web to the lead end of the second web, in some forms of the invention. In some forms of the invention, an out-feed speed of feeding the uncoiled section in the out-feed direction along the web path may be reduced while splicing the tail end of the first web to the lead end of the second web.

Some forms of the invention may include accumulating a stored portion of the uncoiled section of the first web along the web path prior to severing the uncoiled section of the first web. This accumulated stored portion may be utilized for a variety of purposes in practicing the invention, including continuing to provide a flow of the web material along the web path during the process of changing from the first to the second coil and forming the splice between the first web and the second web.

Some forms of the invention may include accumulating a stored portion of the uncoiled section of the first web along the web path prior to severing the uncoiled section of the first web, and pulling part of the stored portion of the uncoiled section back along the web path while winding the portion of the uncoiled section about the splice roll.

In some forms of the invention, the splice roll may be brought into contact with the outer surface of the uncoiled section of the first web while the uncoiled section is attached to the coiled section of the first web, and severing the uncoiled section to form the tail end of the first web. Prior to severing the uncoiled section, in some forms of the invention, the uncoiled section may be deflected from a running path thereof to a cutting position thereof through movement of the splice roll axis while the splice roll is bearing against the outer surface of the uncoiled section of the first web.

Prior to severing the first web, the splice roll may be rotated into a predetermined cutting position, in some forms of the invention. The splice roll may be rotated a predetermined distance about the splice roll axis after severing the first web A method according to the invention may be at least partly performed in an automated process, wherein, performing at least one step of the method automatically initiates at least a second step of the method according to a predetermined sequence of steps. In various forms of the invention, the first and second steps of a method performed in an automated process may be selected from the steps consisting of:

mounting the first coil on the unwind axis;

feeding the uncoiled length of the first coil along the web path;

bringing the splice roll into contact with the outer surface of the uncoiled section first web while the uncoiled section is attached to the coiled section of the first web, and severing the uncoiled section to form the tail end of the first web;

prior to severing the uncoiled section, deflecting the uncoiled section from a running path thereof to a cutting position thereof through movement of the splice roll axis while the splice roll is bearing against the outer surface of the uncoiled section;

rotating the splice roll into a predetermined cutting position prior to severing the first web;

attaching the uncoiled section of the first web to the splice roll prior to severing the first web;

rotating the splice roll a predetermined distance about the splice roll axis after severing the first web;

accumulating a stored portion of the uncoiled section of the first web along the web path prior to severing the uncoiled section of the first web;

pulling part of the stored portion of the uncoiled section back along the web path while winding the portion of the uncoiled section about the splice roll;

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis;

applying the pressure sensitive adhesive to the outer surface of the second web upstream from the lead end of the second web;

continuing to feed the uncoiled section of the first web along the web path in the out-feed direction while splicing the tail end of the first web to the lead end of the second web; and reducing an out-feed speed of feeding the uncoiled section in the out-feed direction along the web path while splicing the tail end of the first web to the lead end of the second web.

In some forms of the invention, winding a portion of the uncoiled section of the first web adjacent the tail end of the first web about a splicing roll may include the steps of:

bringing the splice roll into contact with the outer surface of the uncoiled section first web while the uncoiled section is attached to the coiled section of the first web, and severing the uncoiled section to form the tail end of the first web;

prior to severing the uncoiled section, deflecting the uncoiled section from a running path thereof to a cutting position thereof through movement of the splice roll axis while the splice roll is bearing against the outer surface of the uncoiled section;

rotating the splice roll into a predetermined cutting position prior to severing the first web;

attaching the uncoiled section of the first web to the splice roll prior to severing the first web;

rotating the splice roll a predetermined distance about the splice roll axis after severing the first web;

accumulating a stored portion of the uncoiled section of the first web along the web path prior to severing the uncoiled section of the first web; and pulling part of the stored portion of the uncoiled section back along the web path while winding the portion of the uncoiled section about the splice roll.

Joining the tail end of the first coil to the lead end of the second coil, according to the invention, may include the steps of:

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis; and applying the pressure sensitive adhesive to the outer surface of the second web upstream from the lead end of the second web.

Some forms of the invention may include continuing to feed the uncoiled section of the first web along the web path in the out-feed direction while splicing the tail end of the first web to the lead end of the second web. Some forms of the invention may include reducing an out-feed speed of the uncoiled section in the out-feed direction along the web path while splicing the tail end of first web to the lead end of the second web.

Joining the tail end of the first coil to the lead end of the second coil may include the steps of:

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis; and applying the pressure sensitive adhesive to the outer surface of the second web upstream from the lead end of the second web.

An apparatus, according to the invention, may include a splice roll and a splice roll drive arrangement. The splice roll defines a periphery thereof and is mounted for rotation about a splice roll axis oriented substantially parallel to the unwind axis. The spice roll is configured for winding a portion of the uncoiled section of the first web adjacent the tail end of the first web about the periphery of the splice roll, by attaching the outer surface of the portion of the uncoiled section adjacent the tail end of the first web to the splice roll and rotating the splice roll about the splice roll axis in a direction opposite to the winding direction of the coils.

The splice roll drive arrangement is operatively connected between the splice roll axis and the unwind axis for selectively translating the splice roll axis to bring the tail end of the first web wound around the periphery of the splice roll into rolling contact with the outer surface of the second coil. The splice roll drive arrangement is further configured for pressing the trail end of the first web against the outer surface of the second coil when the second coil is mounted for rotation about the unwind axis. As the splice roll drive arrangement urges the splice roll into rolling contact with the outer surface of the second coil, the tail end of the first coil is joined to the lead end of the second coil, through compression of an adhesive between the inside surface of the tail end of the first coil and the outer surface of the second coil, by urging the splice roll against the second coil while the second coil is rotating about the unwind axis in the unwind direction and the splice roll is rolling about the splice roll axis in a direction opposite to the unwind direction.

An apparatus, according to the invention, may also include a coil drive arrangement for receiving the first and second coils and driving the coils in at least the unwind direction about the unwind axis. An apparatus may also include a coil replacement arrangement for facilitating removal of the first coil from the unwind axis and mounting the second coil about the unwind axis.

Some forms of the invention may also include an accumulator arrangement for accumulating a stored portion of the uncoiled section of the first web along the web path prior to severing the uncoiled section of the first web. The accumulator arrangement may include a festoon arrangement.

A splice roll drive arrangement, according to the invention, may selectively drive the splice roll about the splice roll axis in at least a direction opposite to the winding direction of the coils. A splice roll drive arrangement may further include an articulated member having a proximal end and a distal end thereof. The proximal end of the articulated member may be mounted for pivotable motion about an articulated member axis extending substantially parallel to the unwind axis. The splice roll may be rotatably mounted to the distal end of the articulated member for rotation about the splice roll axis.

A splice roll, according to the invention, may include vacuum elements for attaching the outer surface of the portion of the uncoiled section adjacent the tail end of the first web to the splice roll.

Some forms of the invention may also include a cutting arrangement for severing the first web of material when the first web of material is brought into contact with the cutting arrangement by the splice roll. The cutting arrangement may include a blade, and the splice roll may include grooves therein for receiving the blade. A cutting arrangement may also include a pair of nip rolls disposed on either side of the blade in such a manner that the splice roll urges the first web of material against the nip rolls when the first web of material is brought into contact with the cutting arrangement by the splice roll.

Some forms of the invention may also include a controller operatively connected between the cutting arrangement and the splice roll drive arrangement for rotating the splice roll to an angular position about the splice roll axis, with respect to the blade, whereat one of the grooves in the splice roll is aligned to receive the blade, and for actuating the blade to enter the groove in the splice roll for severing the web.

In forms of the invention having vacuum elements for attaching the outer surface of the portion of the uncoiled section adjacent the tail end of the first web to the splice roll, a controller may be operatively connected for selectively applying vacuum to the vacuum elements. A controller may further be operatively connected for controlling translation of the splice roll, in some forms of the invention.

The invention may also take the form of a computer readable medium storing a computer program for implementing the steps of a method according to the invention.

Other aspects, objects and advantages of the invention will be apparent from the following detailed description and the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 1:
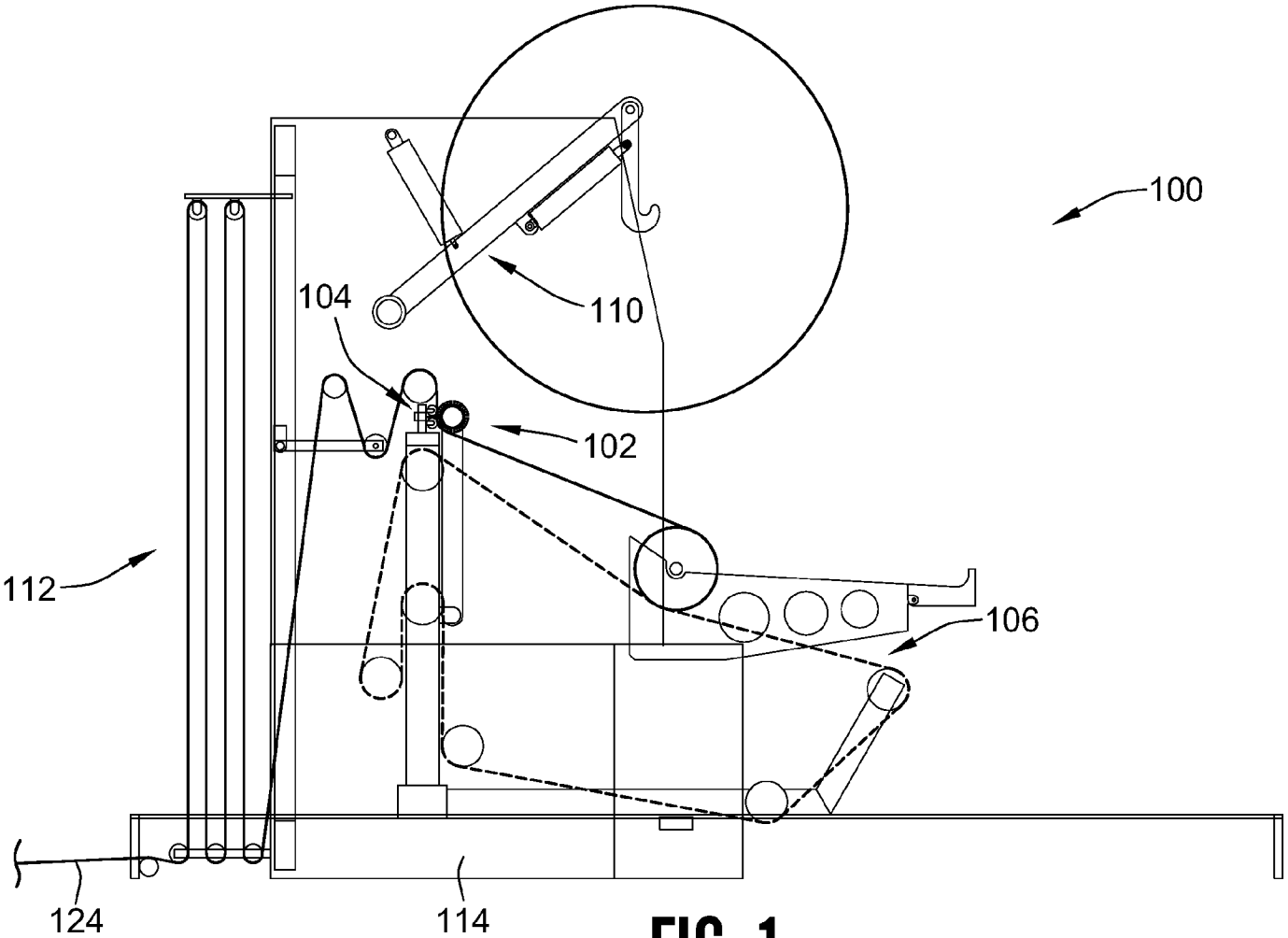
FIG. 1 is a schematic illustration of an exemplary embodiment of an unwind stand, according to the invention.
Figure 2:
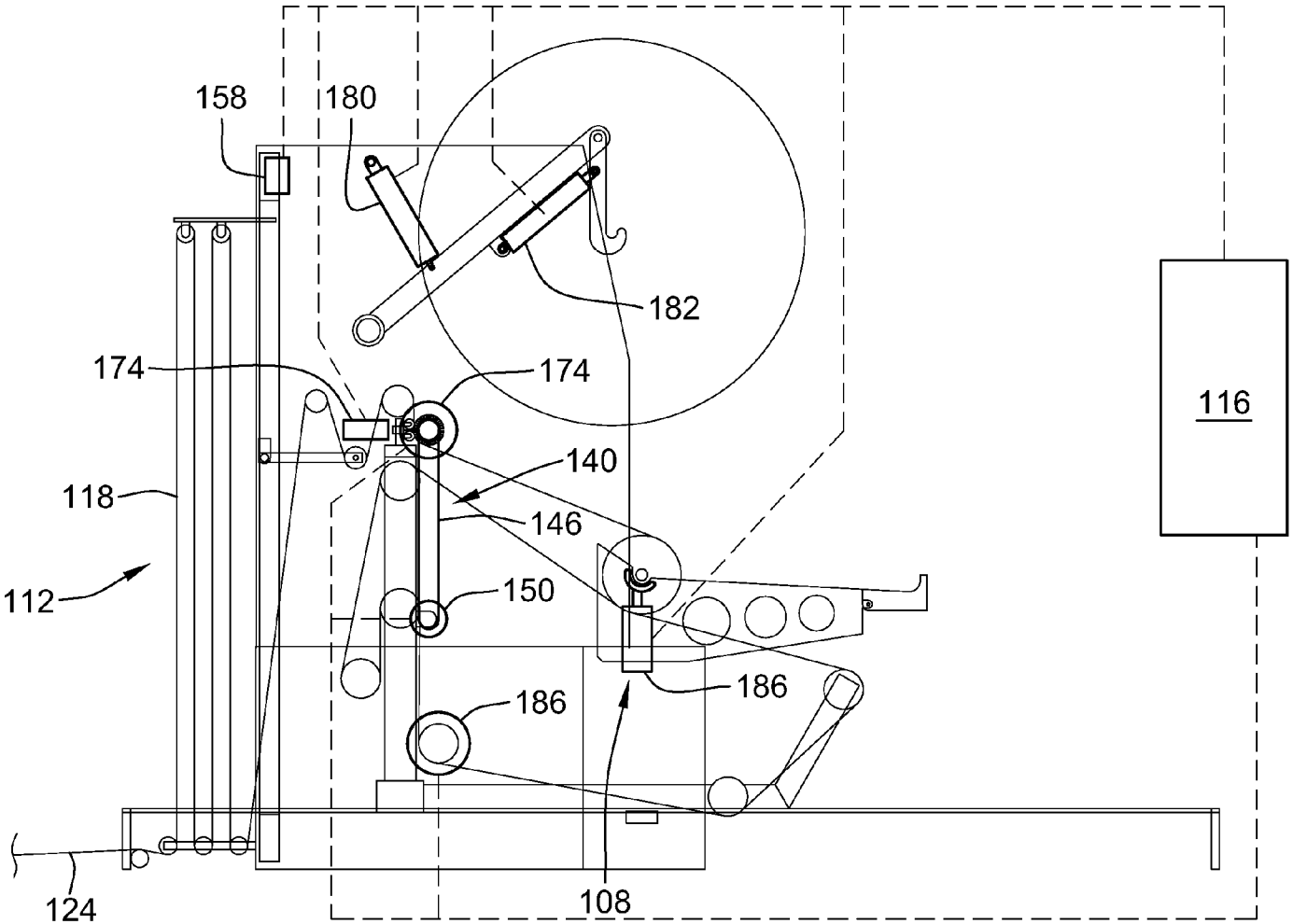
FIG. 2 is a schematic illustration showing the operative connection between a controller and various motor and actuator elements of the unwind stand of FIG. 1.

FIGS. 1 and 2 show a first exemplary embodiment 100 of an automated unwind stand with auto-splicing capability. The exemplary embodiment of the unwind stand 100 includes: a splicing arrangement 102, a cutting arrangement 104, a coil drive arrangement 106, a spent coil ejection arrangement 108, a staged coil handling arrangement 110 and a web accumulator arrangement 112, all mounted in a frame 114 of the unwind stand 100. As shown in FIG. 2, the exemplary embodiment of the unwind stand 100 also includes a controller 116, which is operatively connected to actuators and motors in various parts of the unwind stand 100, for automated operation of the stand 100 as described in more detail below. Those having skill in the art will appreciate that, although the controller 116 is shown as a single unit in the exemplary embodiment of the unwind stand 100, in other embodiments of the invention the controller may be broken into a number of separate units some of which operate automatically and others which may involve manual operation.

Figure 3:
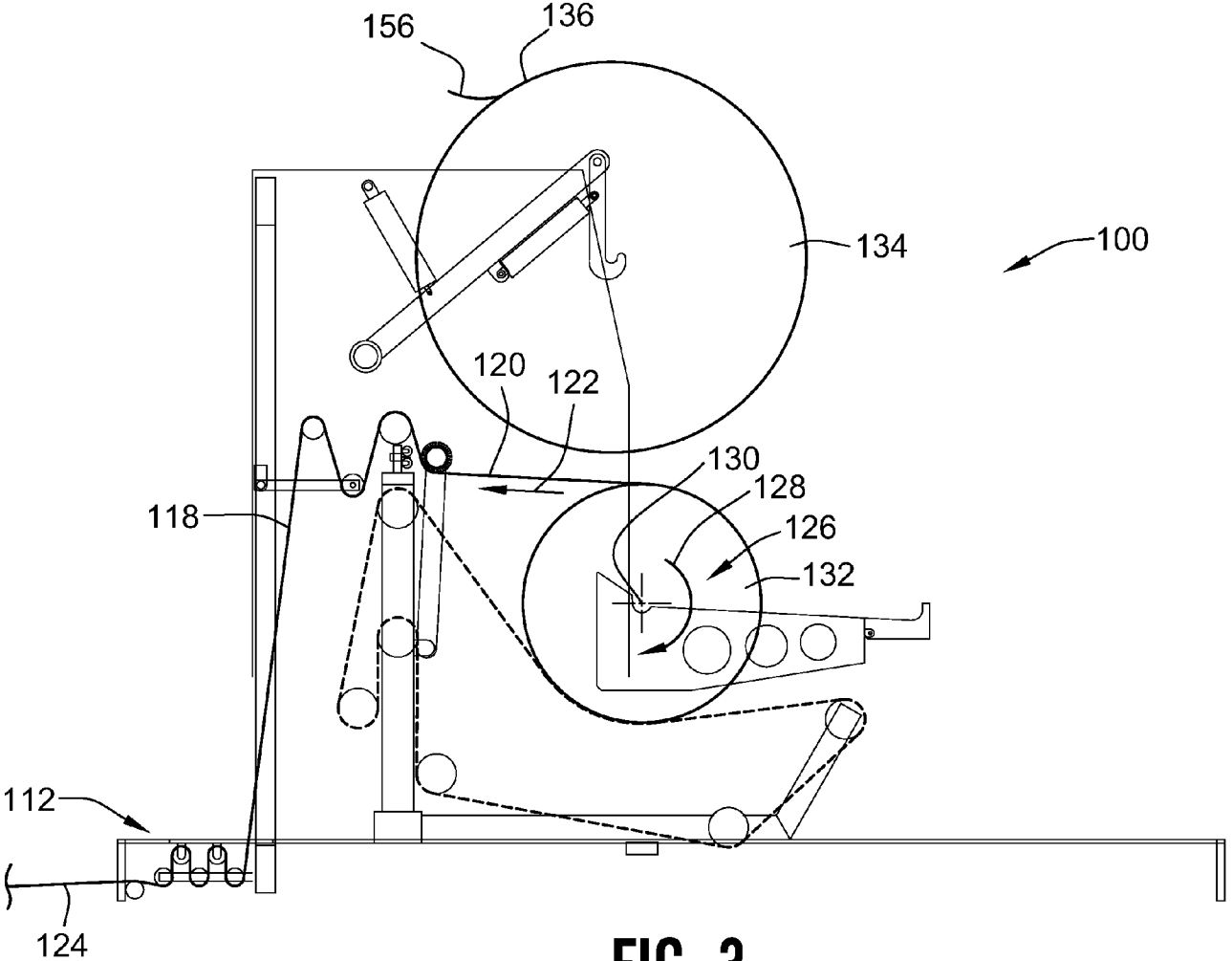
FIG. 3 is a schematic illustration of the unwind stand of FIG. 1 configured for feeding a web of material from a first coil of material along a web path.

FIG. 3 shows the unwind stand 100 supplying a first web 118 having an uncoiled section 120 thereof extending in an out-feed direction 122 along a web path 124. The first web 118 also has a coiled section 126 thereof, which is coiled in a winding direction 128, opposite the out-feed direction 122 about an unwind axis 130.

FIG. 3 illustrates the various components of the unwind stand 100 positioned for providing a continual flow of the first web 118 along the web path 124 from a partly expended first coil 132. FIG. 3 also illustrates a second coil 134 of a second web 136 mounted in a staged position in the staged coil handling arrangement 110.

Figure 4:
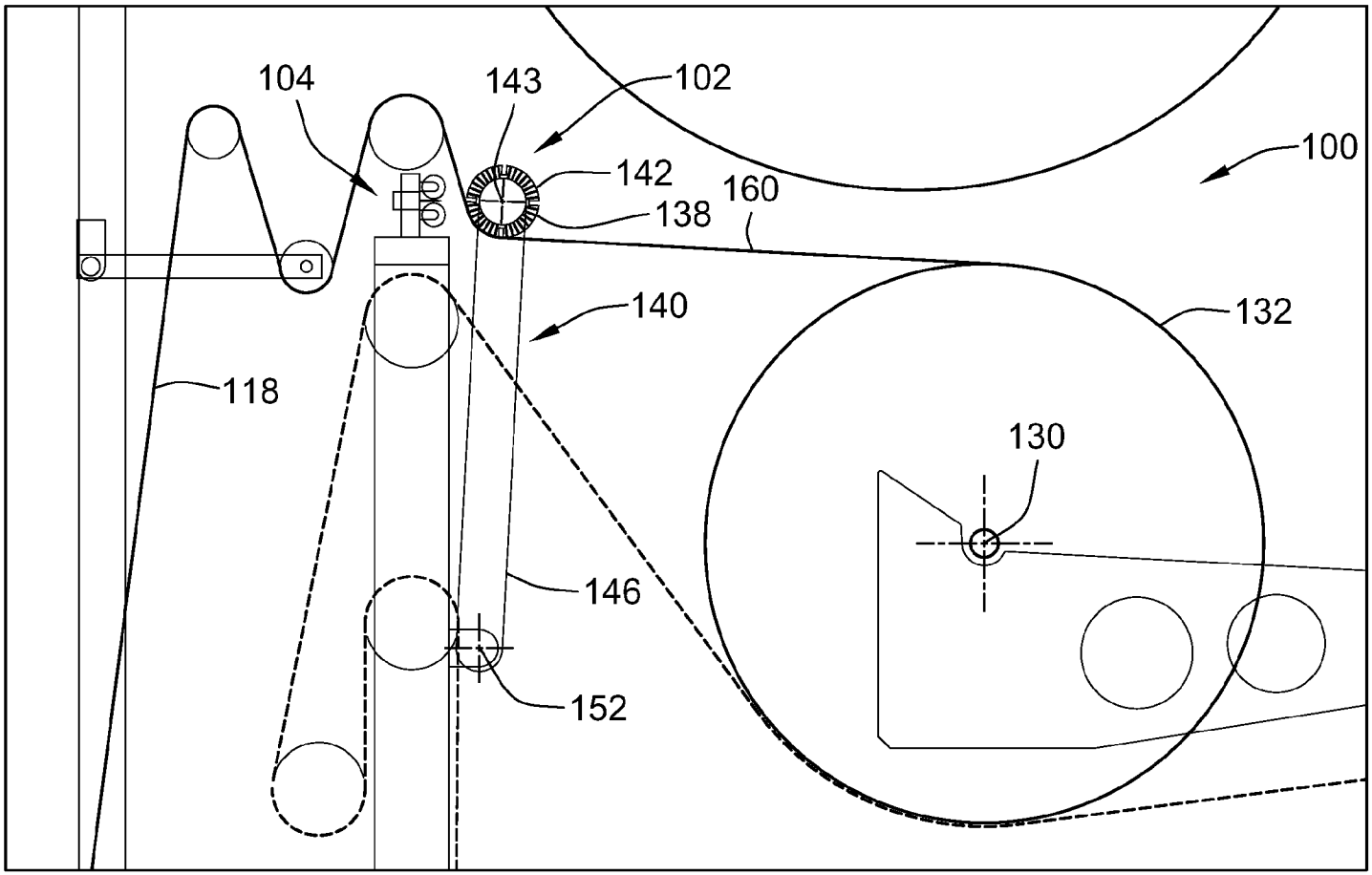
FIG. 4 is an enlarged view of a portion of FIG. 3, showing elements of a splicing arrangement of the unwind stand of FIG. 1.

FIG. 4 is an enlarged view of components of the splicing arrangement 102 and the cutting arrangement 104 in the position of those elements as shown in FIG. 3. The splicing arrangement includes a splice roll 138 and a splice roll drive arrangement 140, with the splice roll drive arrangement 140 having components in the exemplary embodiment shown partly in FIG. 4 and partly in FIG. 2, as will be described in greater detail below.

The splice roll 138, in the exemplary embodiment of the splicing arrangement 102, defines a periphery 142 and is mounted for rotation about a splice roll axis 143 which is oriented substantially parallel to the unwind axis 130.

The splice roll drive arrangement 140 includes an articulated member 146, a splice roll drive motor 148 and a splice roll positioning motor 150, with the splice roll drive motor 148 and splice roll positioning motor 150 being shown only in FIG. 2. The splice roll drive motor 148 and splice roll positioning motor 150 are omitted from FIG. 4 to facilitate illustration of other elements and aspects of the splicing arrangement 102.

As shown in FIG. 4, the articulated member 146 of the splice roll drive arrangement 140 has a proximal end thereof which is mounted to the frame 114 for pivotable motion about an articulated member axis 152 which extends substantially parallel to the unwind axis 130. The splice roll 138 is rotatably mounted to be driven by the splice roll drive motor 148 at the distal end of the articulated member 146 for rotation about the splice roll axis 143. The splice roll positioning motor 150 is operatively connected between the frame 114 and the articulated member 146 at the proximal end of the articulated member 146 for urging the articulated member 146 to pivot about the articulated member axis 152, to thereby cause translation of the splice roll axis 143 with respect to the unwind axis 130 during operation of the unwind stand 100.

Additional details of the construction and operation of the exemplary embodiment of the unwind stand 100 will now be described with reference to FIGS. 2-15, which sequentially show operation of the unwind stand 100 during an automated roll-change and splicing process.

FIG. 3 illustrates the unwind stand 100 just prior to initiation of the automated splicing operation. The exemplary embodiment of the unwind stand 100 is a schematic representation of an unwind stand, according to the invention, of a type which might be used in the paper processing industry for feeding a web of material to a printing or folding machine, for example. Such machines typically work with very large rolls of material to maximize production speed and efficiency. Such rolls of material may be 100 inches in diameter and several feet in length.

As shown in FIG. 3, the first coil 132 of material has been reduced to approximately ½ of its original diameter. In an unwind stand for the paper processing industry, as described in the preceding paragraph, wherein the unwind stand 100 is providing a web of paper to a printing or folding machine, this would mean that the first coil 132 has been reduced from an initial 100 inch diameter to approximately 50 inches in diameter. At normal feeding speeds for such printing and folding equipment, this would equate to the partly expended first coil having enough material still wound thereupon to continue feeding web for approximately another 30 minutes of operation of the printing or folding machine.

It is contemplated that when the first coil 132 has been reduced in diameter to some predetermined dimension, such as approximately ½ of the original diameter in the present example, an operator of the unwind stand 100 would load the second coil 134 into the staged position in the staged coil handling arrangement 110. It is further contemplated that various embodiments of the invention may include sensors and audible or visual alerting systems to detect that the first coil 132 has been expended to the point where it is time to being preparations for splicing in the second coil 134.

In order to complete the splice, a splicing apparatus or method, according to the invention may include provisions for manually or automatically apply and activate an adhesive between faying surfaces of the tail end of the first coil and the lead end of the second coil. It is contemplated that, within the scope of the invention, a wide variety of adhesives, splicing apparatuses and splicing methods may be applied with efficacy in various embodiments of the invention.

It is contemplated that a pressure sensitive adhesive may be particularly suitable for use in some embodiments of the invention, with the pressure sensitive adhesive being applied in a variety of forms by various appropriate methods and apparatuses. For example, in some embodiments of the invention, it is contemplated that a strip of double-sided, pressure-sensitive tape may be manually or automatically applied between faying surfaces of the tail end of the first coil and the lead end of the second coil. In other embodiments of the invention, it is contemplated that a pattern of pressure-sensitive adhesive may be manually or automatically applied between faying surfaces of the tail end of the first coil and the lead end of the second coil by spraying the pressure sensitive adhesive onto one or both of the faying surfaces.

In some embodiments of the invention using manual installation of a double-sided, pressure-sensitive tape, such as the first exemplary embodiment of the automated unwind stand 100, either prior to or after loading the second coil into the staged coil handling arrangement 110, the operator installs a strip of the pressure-sensitive adhesive tape to an outside surface of the second web 136 at a point adjacent and just upstream of a lead end 156 of the second web 136. In some embodiments of the invention it is contemplated that the tape 154 will always be applied by the operator at approximately the same location about the center of the second coil 134, for example at a three o'clock or a nine o'clock position. The position at which the tape is applied, or stated another way, the desired initial positioning of the tape 154 and the lead end 156 of the second coil 134 will depend somewhat upon the orientation and placement of an unwind stand, according to the invention, and other factors such as whether the web is fed along the web path 124 from the top of a coil mounted for rotation about the unwind axis 130 as is the case in the exemplary embodiment 100, or from the bottom or some other position of the coil when used in other embodiments of the invention having the web feeding from the bottom or some other position of the coil when mounted about the unwind axis 130.

In the first exemplary embodiment of the automated unwind stand 100, once the second coil 134 is mounted in the staged position, as shown in FIG. 3, the operator initiates the auto-splicing process through the controller 116.

The accumulator arrangement 112, in the exemplary embodiment of the unwind stand 100, takes the form of a festoon arrangement, of the type generally known in the art having a series of pulleys about which the first web 118 is threaded. Some of the pulleys are moveable by a festoon actuator 158, in the manner illustrated in FIG. 2, for storing a length of the first web 18 in the festoon to provide a continuous feed of web 118 along the web path 124 during the auto-splice and roll-change operation. It will be understood, however, by those having skill in the art that in other embodiments of the invention it may be more desirable to simply stop feeding the web during the auto-splice and roll-change process. In such applications, an accumulator arrangement may not be necessary.

In the exemplary embodiment of the unwind stand 100, at the outset of the auto-splice and roll-change operation, the festoon 112 extends to store a length of the first web 118. It is also contemplated, that some embodiments of the invention may include reducing the out-feed speed of the web 118 along the web path 124 during the auto-splice and roll-change operation.

During normal feeding operations of the unwind stand 100, and through the early stages of the auto-splice and roll-change operation, the periphery 142 of the splice roll 138 is in contact with an outer surface 160 of the first web 118, with the splice roll 138 rotating at sufficient speed about the splice roll axis 143 that there is substantially no slippage between the periphery 142 of the splice roll 138 and the first web 118. In some embodiments of the invention, the splice roll drive motor 148 may be utilized for driving the splice roll 138 in a direction opposite to the motion of the first coil 132 about the unwind axis 130.

As shown in FIGS. 5-9, the controller 116 next utilizes the splicing arrangement 112 and the cutting arrangement 104 to sever the first web 118 to form a tail end 162 of the first web 118, and to wind a portion of the uncoiled section 120 of the first web 118 adjacent the tail end 162 of the first web about the periphery 142 of the splice roll 138.

Figure 5:
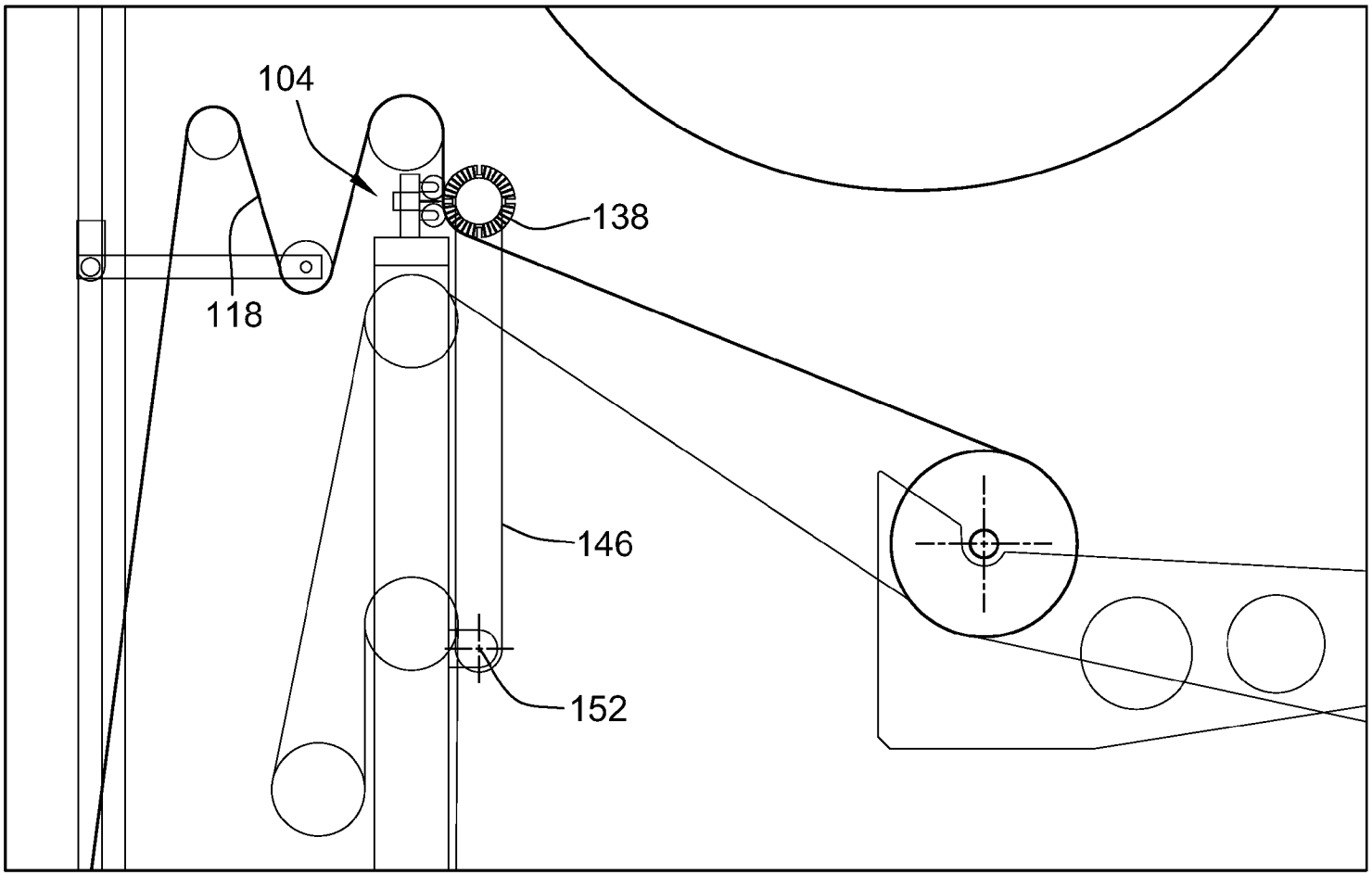
FIGS. 5-9 are enlarged partial views of the unwind stand of FIG. 1 showing operation of a cutting arrangement and a splicing arrangement of the unwind stand of FIG. 1, as a first web is severed to form a tail end of the first web and a portion of the first web adjacent the tail end is wound about a splice roll of the splicing arrangement.

As shown in FIGS. 2 and 5, this is accomplished by the controller 116 commanding the articulated member drive motor 150 to pivot the articulated member 146 about its axis 152 toward the cutting arrangement 104, such that the first web 118 is pinched between the periphery 142 of the splice roll 138 and the peripheries of a pair of nip rollers 164, 166 disposed on opposite sides of a cutting blade 168 of the cutting arrangement 104.

Figure 6:
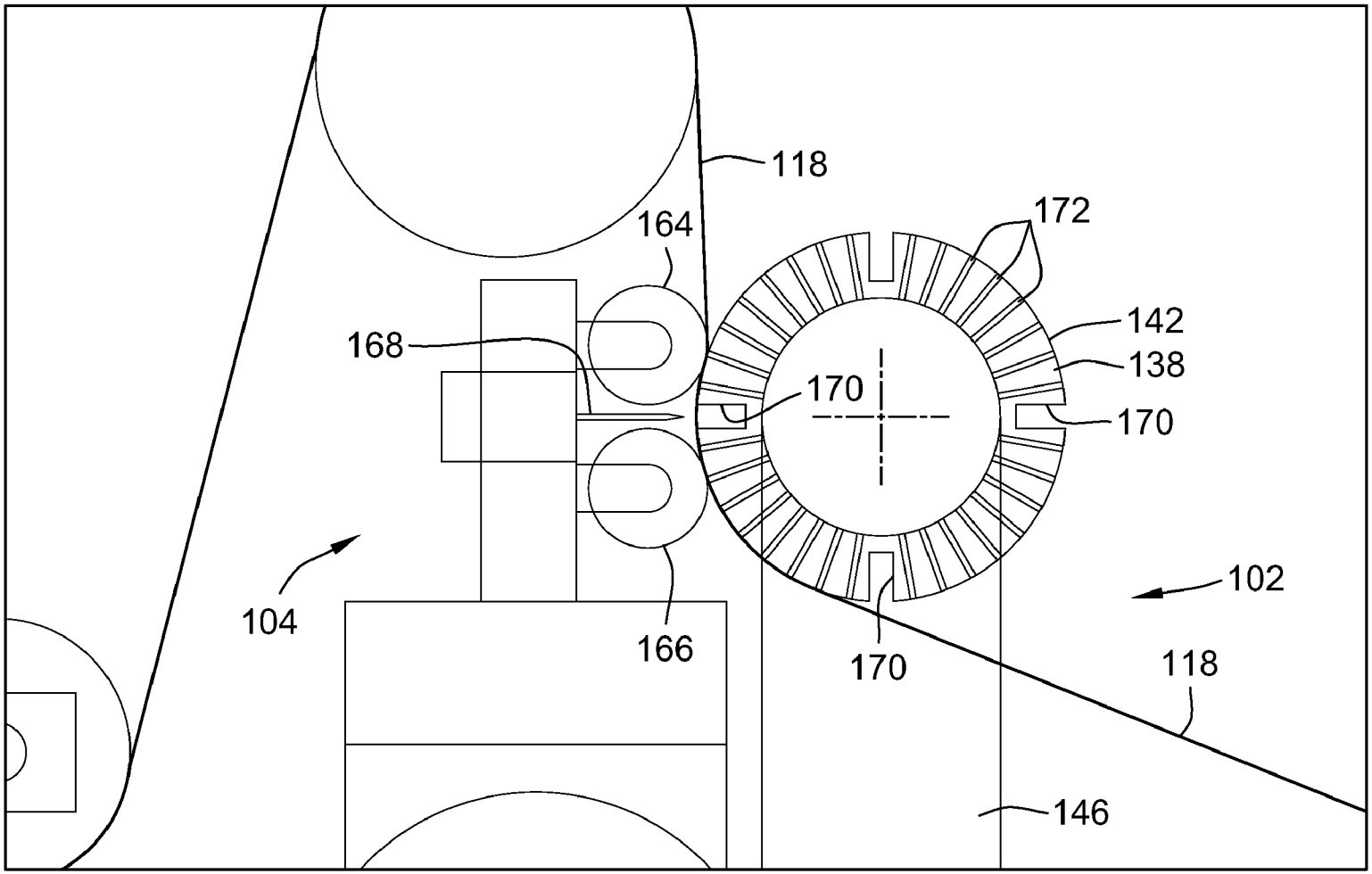

As shown in FIG. 6, the controller 116 will then cause the splice roll 148 to rotate to an angular position with respect to the blade 168 at which one or more grooves 170 in the periphery 142 of the splice roll 138 will be aligned for receiving the blade 168. The splice roll 138 of the exemplary embodiment also includes a series of vacuum ports 172 extending through the outer periphery of the splice roll or attaching the outer surface 160 of the first web 118 to the periphery 142 of the splice roll 138. Once the splice roll 138 has one of its grooves 170 aligned with the blade 168, the controller 116 connects the vacuum ports 172 to a source of vacuum (not shown).

Figure 7:
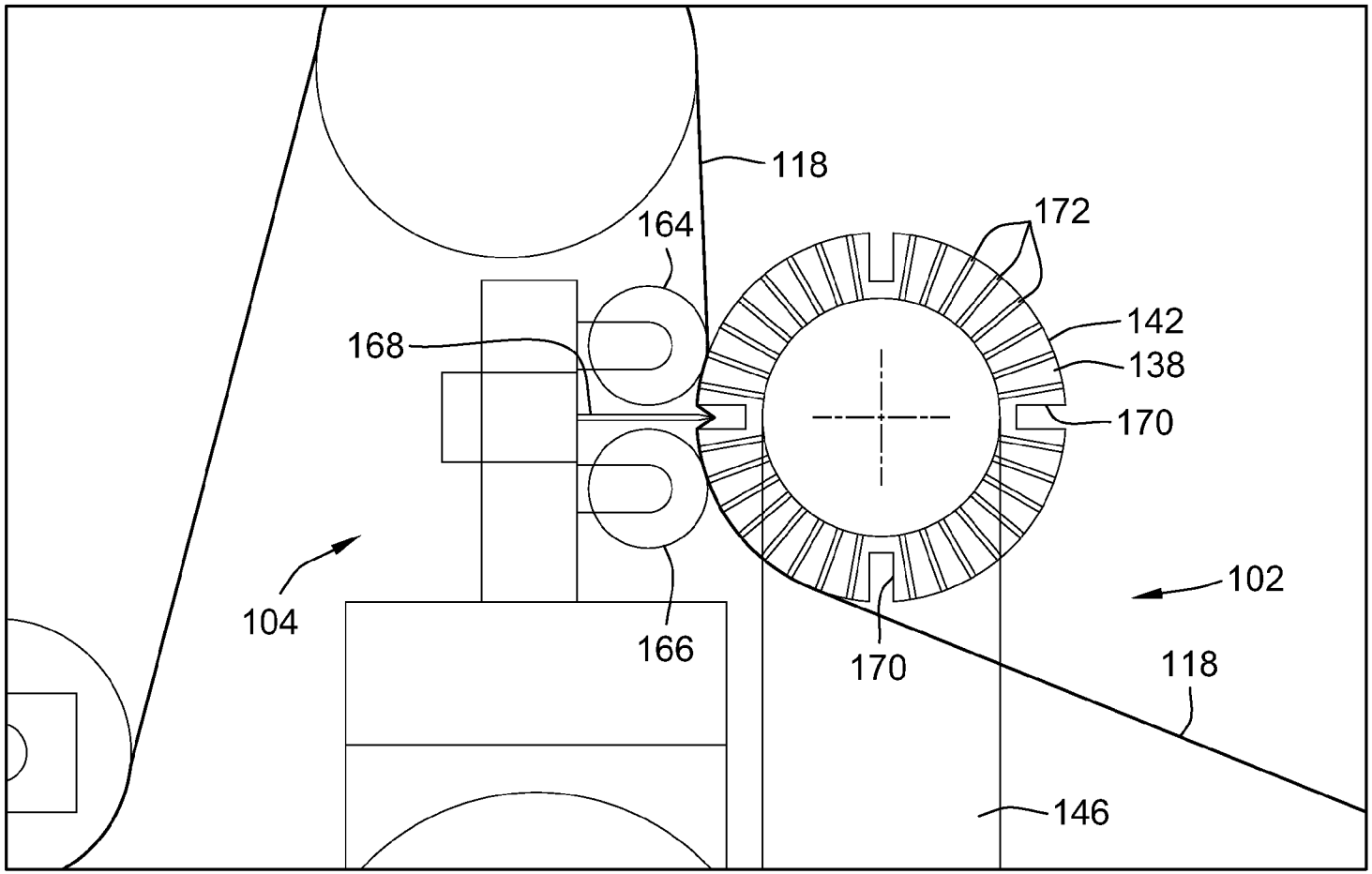

The controller 116 then commands a blade actuator 174 (as shown in FIG. 2) to extend the blade 168 into the slot 170 in the splice roll 138, as shown in FIG. 7, to sever the web 118 and form the tail end 162 of the first web 118.

Figure 8:
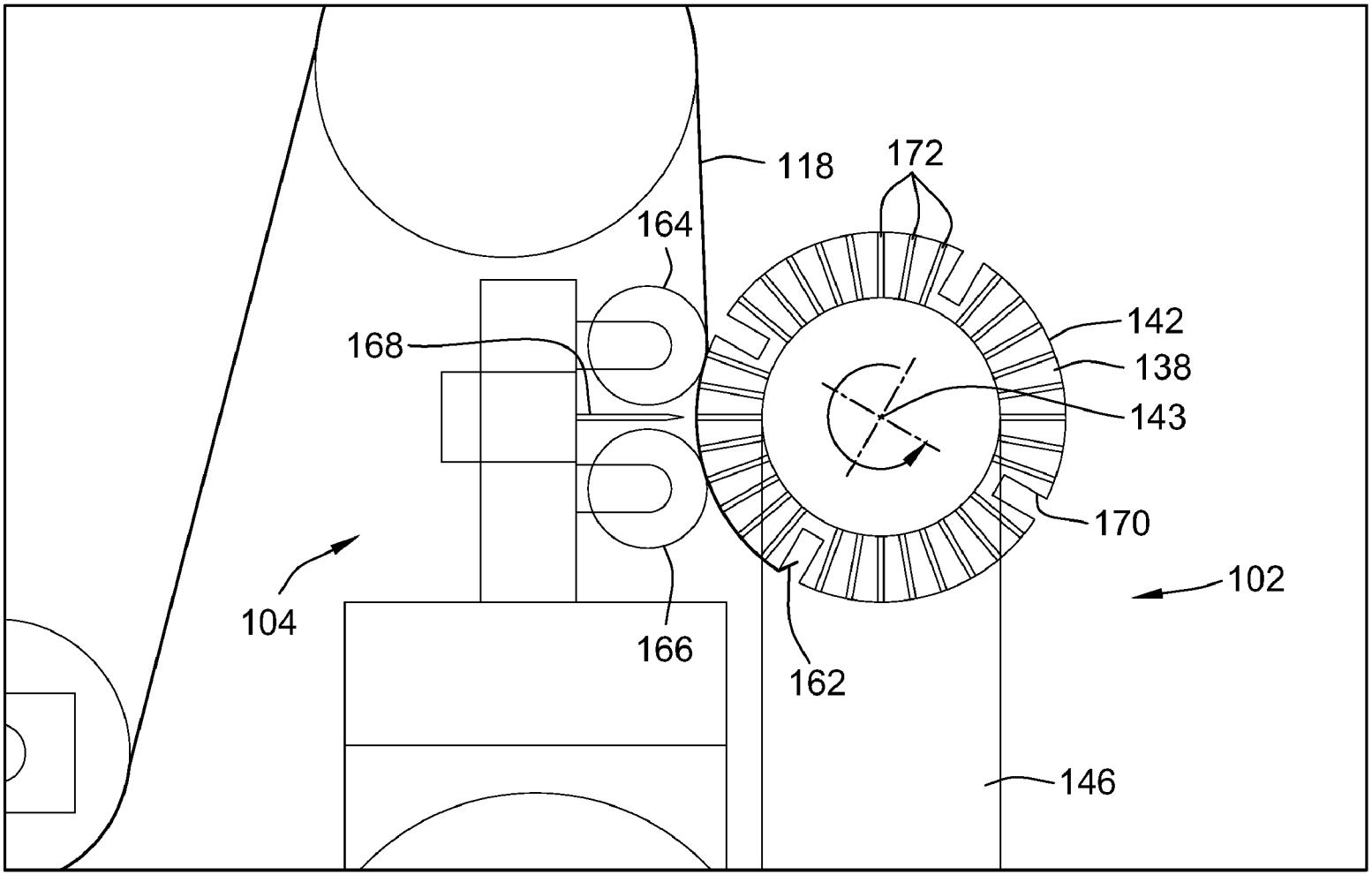
Figure 9:
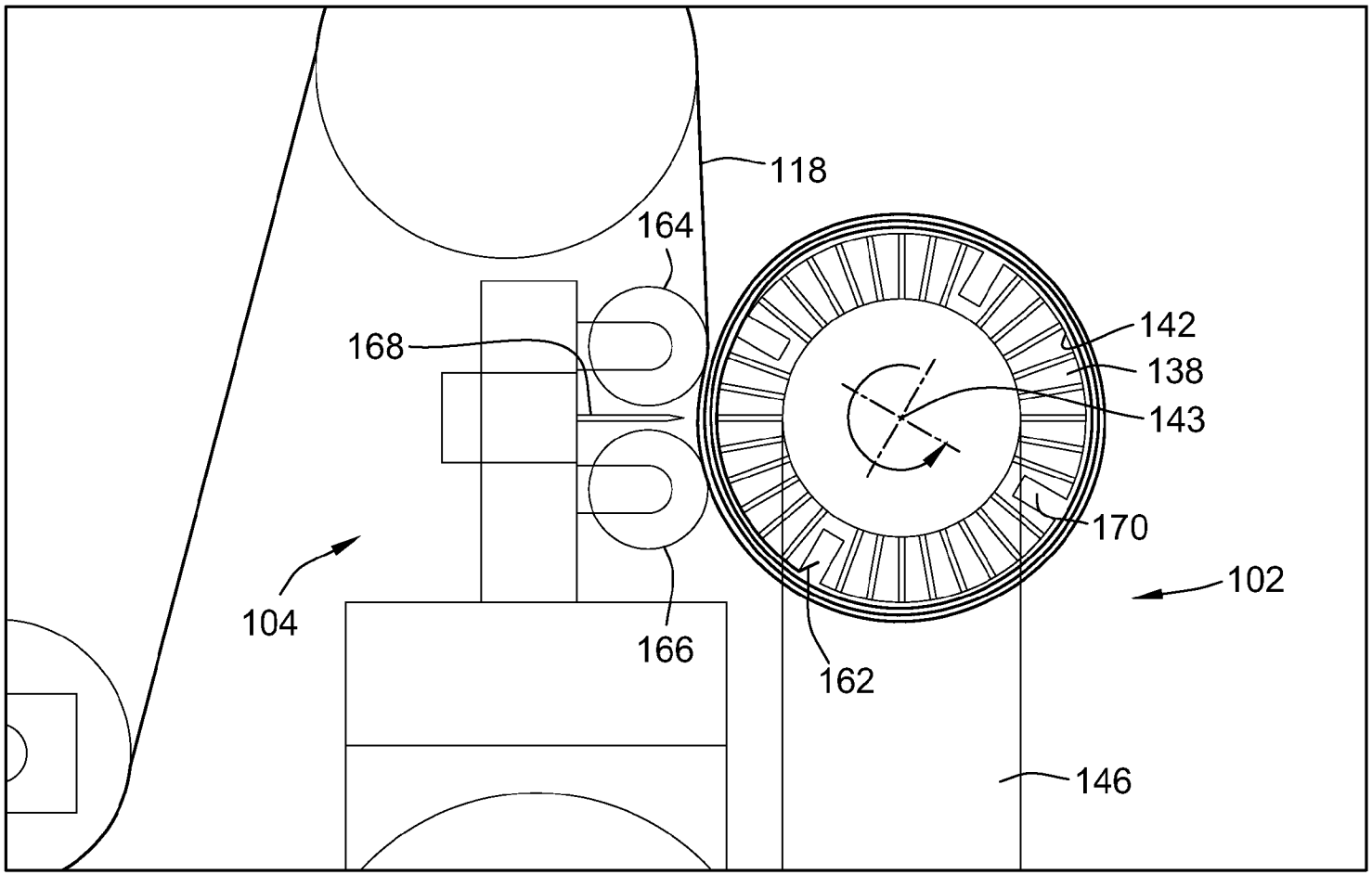

As shown in FIG. 8, after the web 118 is severed, the blade actuator 174 retracts the blade 168 and the splice roll drive motor 148 begins to rotate the splice roll 138 about the splice roll axis 143 in a direction opposite the direction of rotation of the splice roll 138 when web material is being fed past the splice roll 138 to the web path 124. As the splice roll 138 rotates, with vacuum applied to the ports 172 in the periphery 142 of the splice roll, a portion of the first web 118 adjacent the tail end 162 of the first web 118 is held to the outer periphery 142 of the splice roll 138. As shown in FIG. 9, as the splice roll 138 continues to be driven in the direction opposite to the out-feed direction about the splice roll axis 143, a length of the first web 118 adjacent the tail end 162 of the first web 118 is drawn back out of the festoon arrangement 112 and is wound around the periphery 142 of the splice roll 138.

Figure 10:
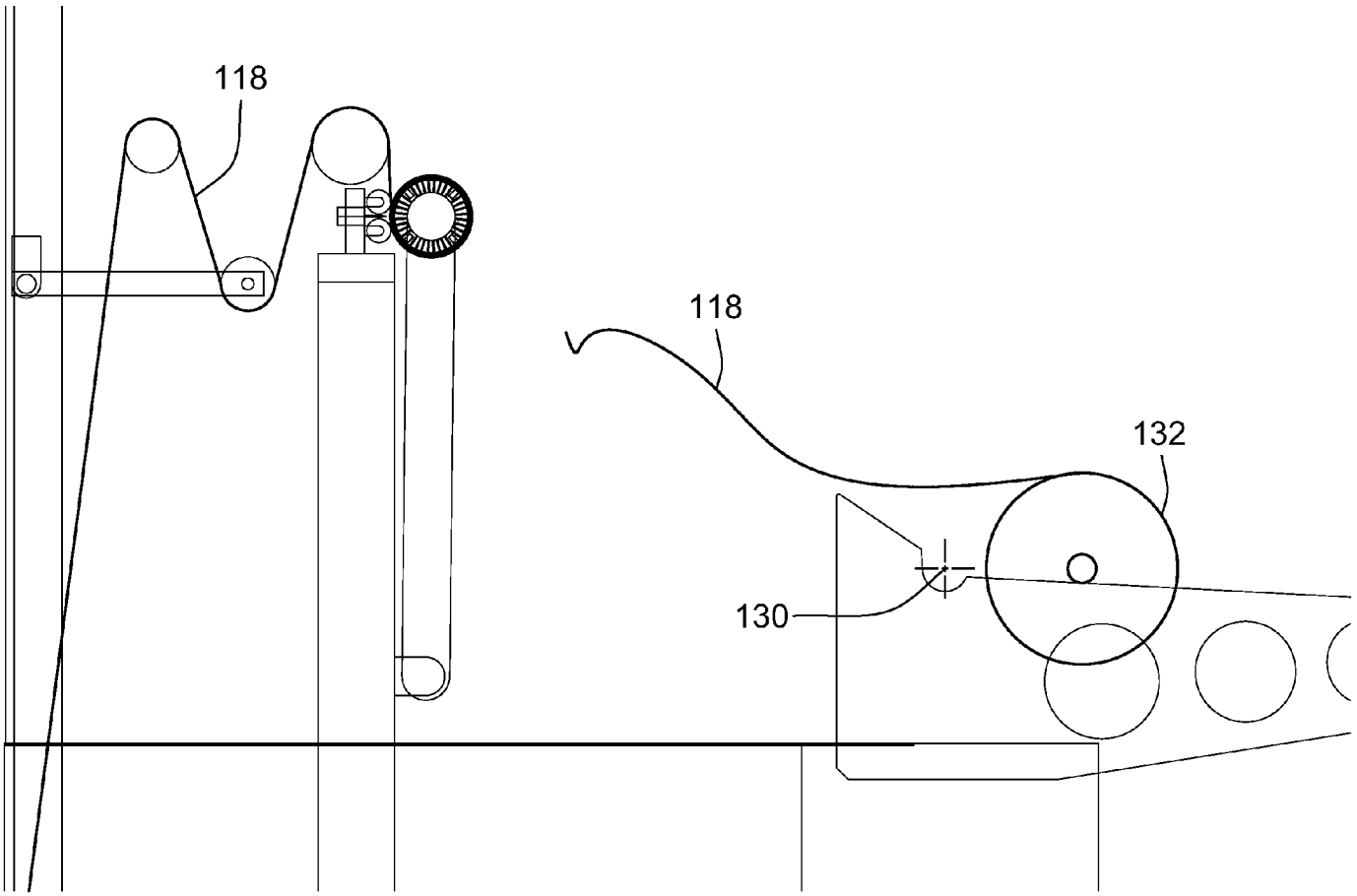
FIGS. 10-12 are schematic illustrations showing the manner in which an exhausted first coil of web material is replaced by a staged second coil of web material utilizing a spent coil ejection arrangement and a staged coil handling arrangement of the unwind stand of FIG. 1.
Figure 11:
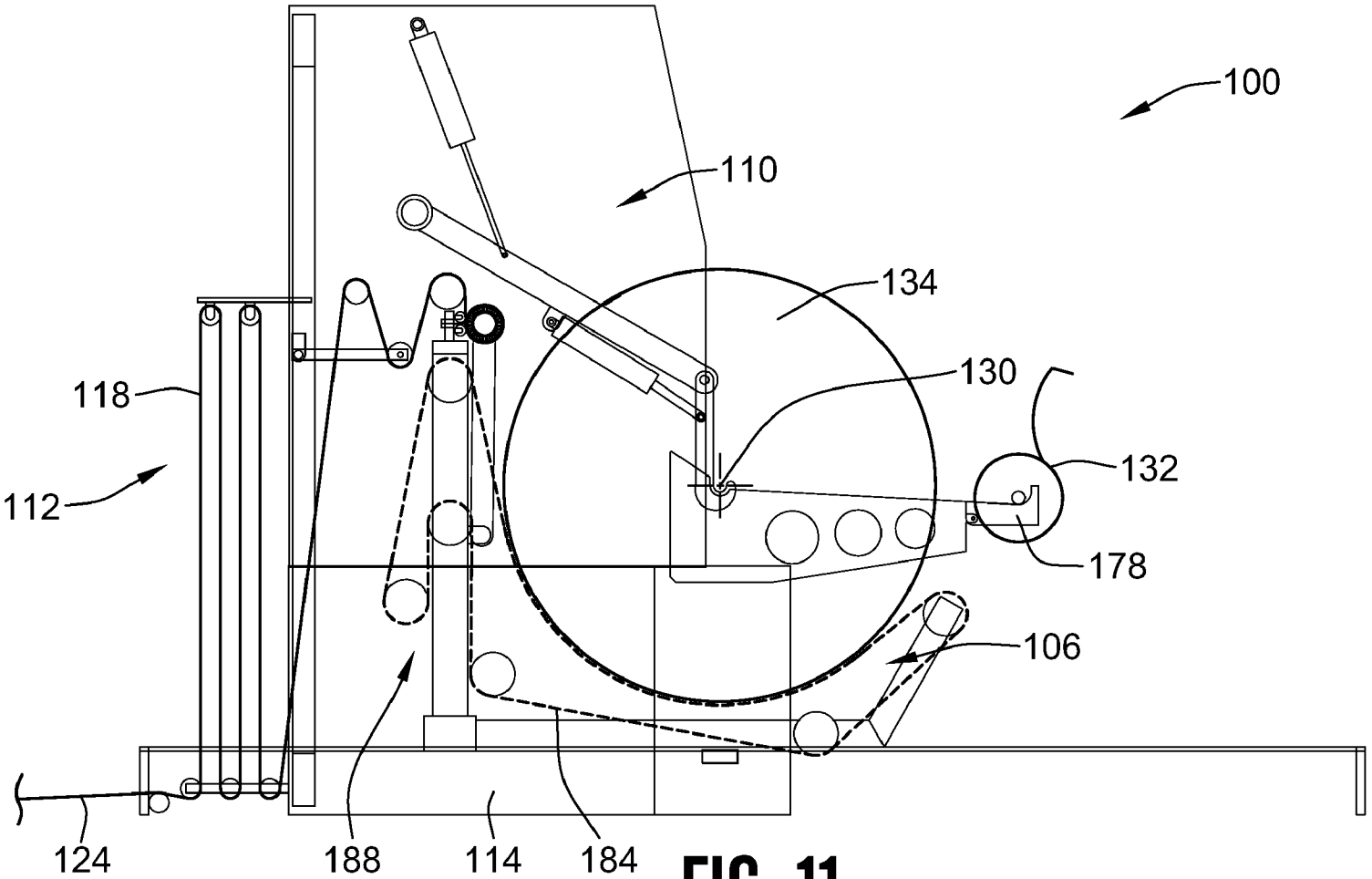
Figure 12:
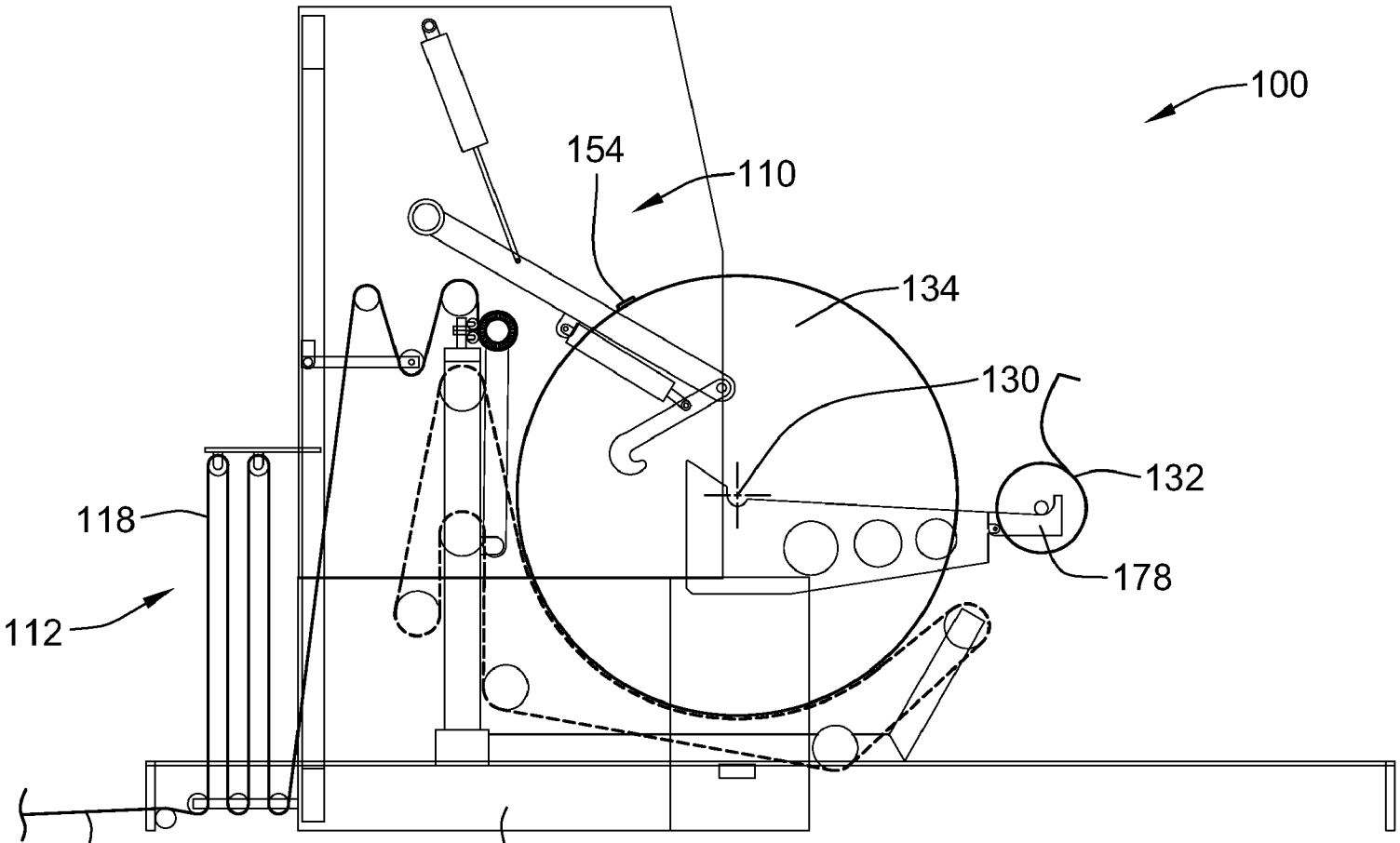

Once the first web 118 is severed, the controller 116 commands of the spent coil ejection arrangement 108 to eject the remainder of the first coil 132 from the unwind axis 130, in the manner illustrated in FIG. 10. As shown in FIGS. 11 and 12, in the exemplary embodiment of the unwind stand 100, the frame 114 includes a pair of rails 178 so that the remainder of the first coil 132 can be readily rolled-away from the unwind axis 130 a sufficient distance to allow the second coil 134 to be mounted for rotation about the unwind axis 130. Lowering of the second coil 134 into position is accomplished by the controller 116 commanding actuators 180, 182 (see FIG. 2) of the spent coil handling arrangement 110 to first lower the second coil 134 into position at the unwind axis 130, as shown in FIG. 11, and then release the second coil 134 and retract toward the staging position shown in FIG. 3, in the manner indicated in FIG. 12. As also indicated in FIGS. 11 and 12, during the splicing and roll change operations, in the exemplary embodiment of the unwind stand 100, the festoon 112 continues to supply a continuous feed of the first web 118 along the web path 124.

As indicated in FIG. 12, once the second coil 134 has been positioned at the unwind axis 130, the coil drive arrangement 106 may be utilized for orienting the strip of pressure-sensitive tape 154 at an advantageous angular location about the unwind axis 130. Specifically, with reference to FIGS. 2 and 12, the coil drive arrangement 106 of the exemplary embodiment of the unwind stand 100 includes an endless belt 184 running around a series of pulleys and driven by a coil drive motor 186. As illustrated in FIG. 12, the coil drive arrangement 106 includes a drive belt festoon arrangement 188 which is configured in such a manner that the endless belt 184 of the coil drive arrangement is pulled into contact with the outer surface of a coil of material mounted at the unwind axis, regardless of the diameter of the coil of material.

In various embodiments of the invention, it is contemplated that the angular position of the pressure-sensitive tape 154 may be set in a variety of appropriate ways. In the first exemplary embodiment 100, it is contemplated that the angular position of the pressure-sensitive tape be adjusted by the coil drive arrangement 106 in a substantially automatic manner, by the controller 116, on the basis of the diameter of the second coil and a known approximate position of initial placement of the pressure-sensitive tape 154 when the second coil 134 is mounted in the staged position in the staged coil handling arrangement 110. In some embodiments of the invention utilizing splicing tape, it is contemplated that the strip of tape 254 may be applied while the second coil 134 is in the staged position, as shown in FIG. 3, or in an intermediate position as the second coil 134 is moved from the staged position to the unwind axis 130. As will be understood by those having skill in the art, the manner in which splicing is accomplished in the present invention provides a substantial degree of tolerance and latitude with respect to the placement of the pressure-sensitive tape 154.

Figure 13:
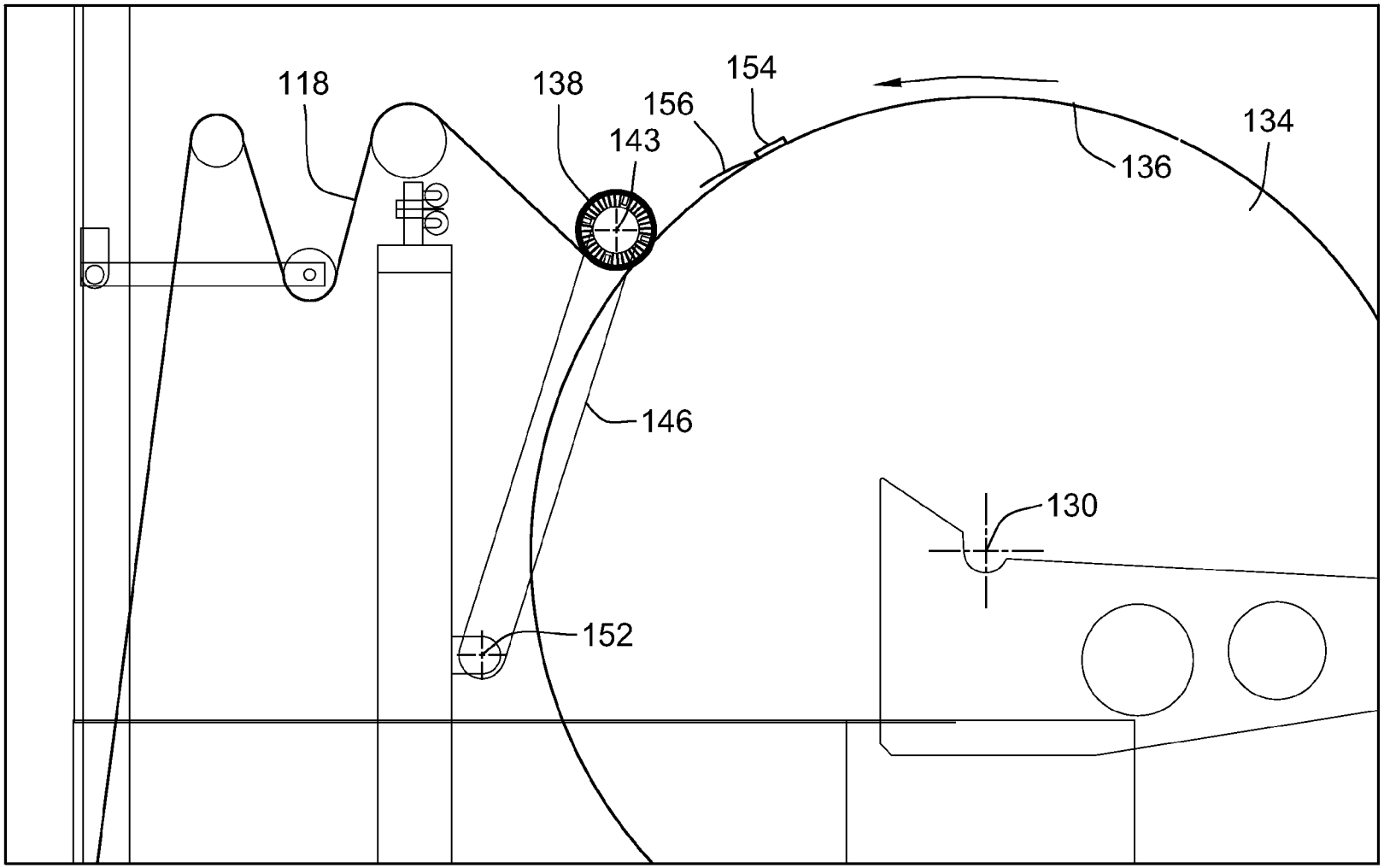
FIGS. 13-15 are sequential schematic illustrations of the manner of forming a splice between a tail end of a first web and a lead end of a second web of material, utilizing a splicing arrangement and a coil drive arrangement of the unwind stand of FIG. 1.

As shown in FIG. 13, once the second coil 134 is mounted for rotation about the unwind axis 130 with the pressure-sensitive tape 154 oriented at a desired location, the controller 116 commands the articulated member drive motor 150 to pivot the articulating member 146 about its axis 152 to thereby cause translating motion of the splice roll axis 143 with respect to the unwind axis 130 in such a manner that the portion of the first web 118 wrapped about the periphery 142 of the splice roll 138 is brought into close proximity with the outer surface of the second coil 134. In the exemplary embodiment of the unwind stand 100, it is contemplated that the articulated member drive motor 150 is capable of operation alternatively in a positioning mode or in a torque mode. During the initial stages of translation of the axis 143 of the splice roll 138 it is contemplated that the articulated member drive motor 150 would be driven in a positioning mode to place the outer periphery 142 of the splice roll adjacent to the second coil 134 in a position where the portion of the first web 118 wound about the splice roll 138 is not quite in contact with the outer surface of the second coil 134. The controller 116 will then command the articulated member drive motor 150 to operate in a torque mode and urge the splice roll 138 to pinch the portion of the first web 118 wound about the periphery of the splice roll 138 against the outer surface of the second coil 134 with sufficient force to cause adhesion of the tail end 162 of the first web 118 with the pressure-sensitive tape 154.

Figure 14:
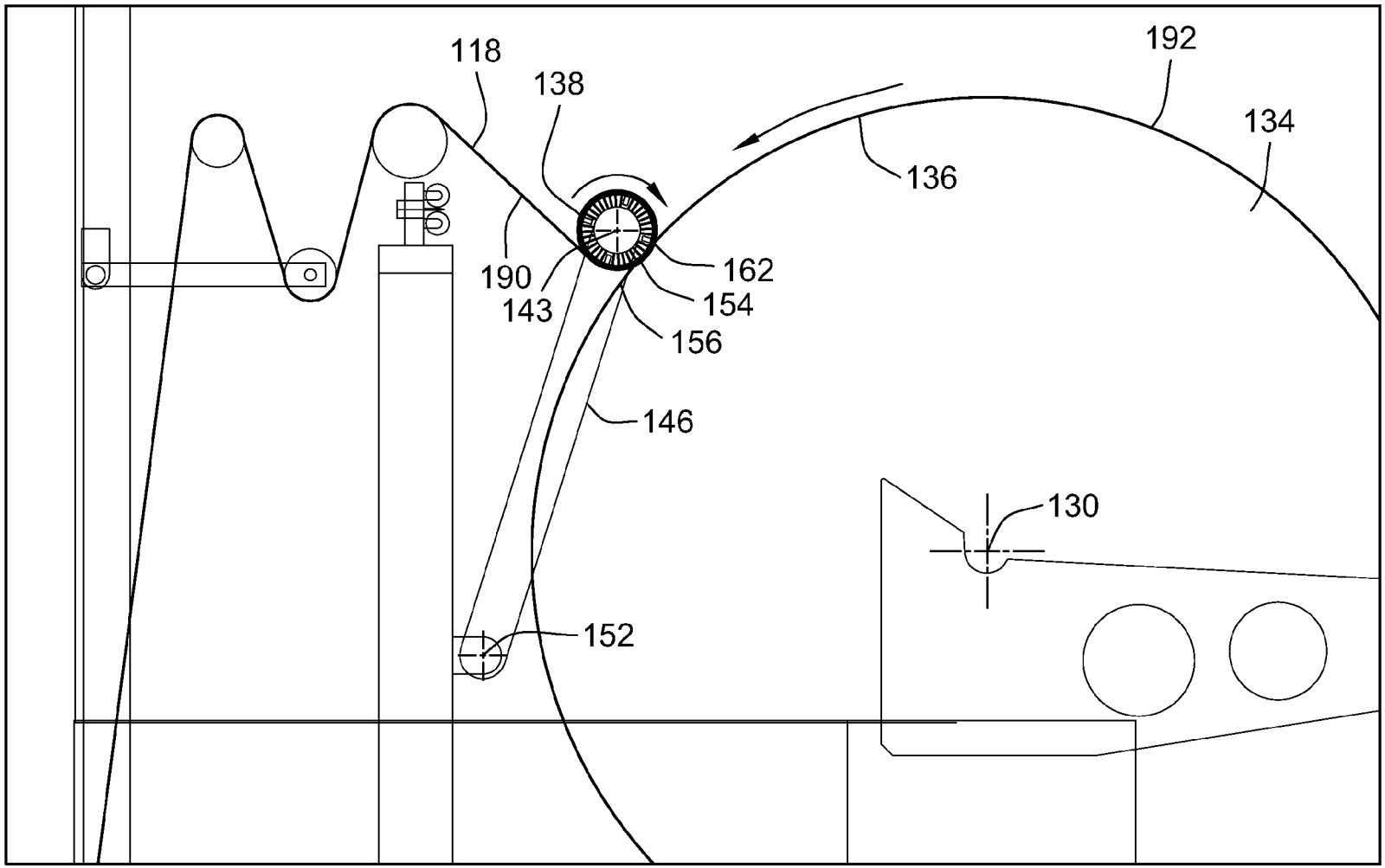
Figure 15:
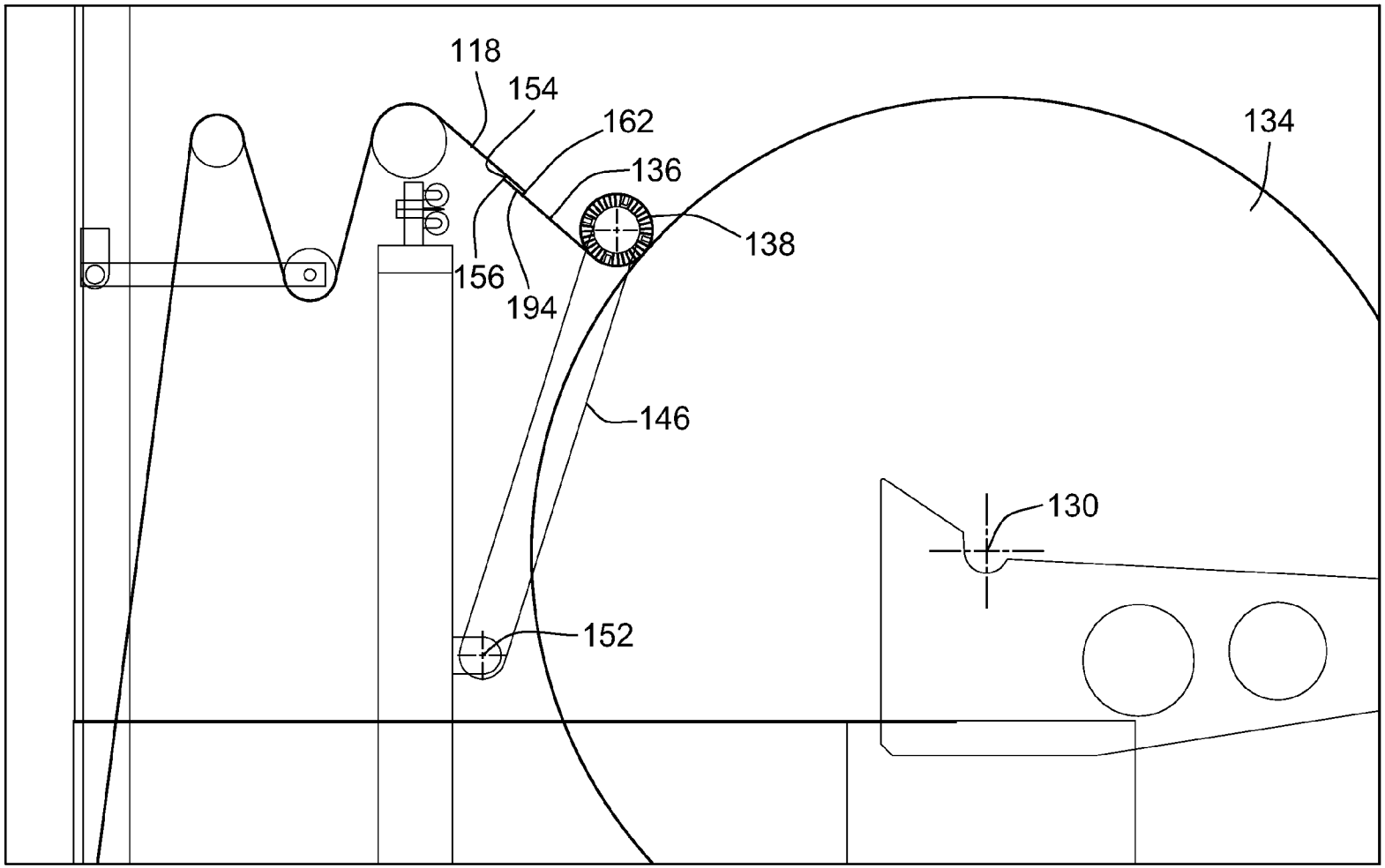

As shown in FIGS. 14 and 15, the controller then commands the coil drive arrangement 106 to begin rotating the second coil 134 in the unwind direction, while the splice roll 138 is being urged against the second coil 134 by operation of the articulated member drive motor 150 in the torque mode. The splice roll drive motor 148 may also be utilized during this step in the process for driving the splice roll in a direction opposite to the unwind direction of the second coil 134.

As illustrated sequentially in FIGS. 13-15, rotation of the second coil 134 and splice roll 138 about the unwind axis and the splice roll axis 143 respectively causes the pressure-sensitive tape 154 to travel between the splice roll 138 and the second coil 134, as the portion of the first web 118 wound about the periphery of the splice roll 138 is unwound onto the surface of the second coil 134. As the pressure-sensitive tape 154 travels between the splice roll 138 and the outer surface 192 of the second coil 134, the pressure-sensitive adhesive is compressed between the inner surface 190 of the first web 118 and the outer surface 192 of the second web 136 in such a manner that the splice 194 is formed between the tail end 162 of the first web 118 and the lead end 156 of the second web 136, as illustrated in FIG. 15.

Once the splice 194 has been successfully formed, the controller 116 will initiate return of the unwind stand to the condition substantially as shown in FIG. 3, whereat the festoon 112 is no longer stowing a length of web, and the speed of feeding web along the web path 124 can be increased back to normal operating speed if it was decreased during the auto-splice and roll-change operation.

FIGS. 16-19 illustrate a second exemplary embodiment of an automated unwind stand 200 with auto-splicing capability, which is essentially identical to the first exemplary embodiment 100 except that the second exemplary embodiment 200 utilizes an automated sprayer arrangement 203 for applying a pattern 254 of pressure-sensitive adhesive to inside surface 190 of a portion of the tail end 162 of the first web 118 during the splicing process. Given the structural and operational similarities between the first and second exemplary embodiments of the automated unwind stand 100, 200, common reference numerals will be used in FIGS. 16-19, and in references to similar construction and operational features, wherever applicable for expediency and clarity of explanation in the following descriptions of the second exemplary embodiment of the automated unwind stand 200.

Regarding the drawing figures, it will be noted that FIGS. 12-15 are generally applicable to both the first and second exemplary embodiments of the unwind stand 100, 200, with the exception that in the second exemplary embodiment 200 the strip of tape 154 shown in FIGS. 12-15 is not used.

In the second exemplary embodiment of the automated unwind stand 200, once the second coil 134 is mounted in the staged position, as shown in FIG. 3, the operator initiates the auto-splicing process through the controller 116.

The accumulator arrangement 112, in the exemplary embodiment of the unwind stand 100, takes the form of a festoon arrangement, of the type generally known in the art having a series of pulleys about which the first web 118 is threaded. Some of the pulleys are moveable by a festoon actuator 158, in the manner illustrated in FIG. 2, for storing a length of the first web 18 in the festoon to provide a continuous feed of web 118 along the web path 124 during the auto-splice and roll-change operation. It will be understood, however, by those having skill in the art that in other embodiments of the invention it may be more desirable to simply stop feeding the web during the auto-splice and roll-change process. In such applications, an accumulator arrangement may not be necessary.

In the exemplary embodiment of the unwind stand 200, at the outset of the auto-splice and roll-change operation, the festoon 112 extends to store a length of the first web 118. It is also contemplated, that some embodiments of the invention may include reducing the out-feed speed of the web 118 along the web path 124 during the auto-splice and roll-change operation.

During normal feeding operations of the unwind stand 200, and through the early stages of the auto-splice and roll-change operation, the periphery 142 of the splice roll 138 is in contact with an outer surface 160 of the first web 118, with the splice roll 138 rotating at sufficient speed about the splice roll axis 143 that there is substantially no slippage between the periphery 142 of the splice roll 138 and the first web 118. In some embodiments of the invention, the splice roll drive motor 148 may be utilized for driving the splice roll 138 in a direction opposite to the motion of the first coil 132 about the unwind axis 130.

As shown in FIGS. 5-9, the controller 116 next utilizes the splicing arrangement 112 and the cutting arrangement 104 to sever the first web 118 to form a tail end 162 of the first web 118, and to wind a portion of the uncoiled section 120 of the first web 118 adjacent the tail end 162 of the first web about the periphery 142 of the splice roll 138.

As shown in FIGS. 2 and 5, this is accomplished by the controller 116 commanding the articulated member drive motor 150 to pivot the articulated member 146 about its axis 152 toward the cutting arrangement 104, such that the first web 118 is pinched between the periphery 142 of the splice roll 138 and the peripheries of a pair of nip rollers 164, 166 disposed on opposite sides of a cutting blade 168 of the cutting arrangement 104.

As shown in FIG. 6, the controller 116 will then cause the splice roll 148 to rotate to an angular position with respect to the blade 168 at which one or more grooves 170 in the periphery 142 of the splice roll 138 will be aligned for receiving the blade 168. The splice roll 138 of the exemplary embodiment also includes a series of vacuum ports 172 extending through the outer periphery of the splice roll or attaching the outer surface 160 of the first web 118 to the periphery 142 of the splice roll 138. Once the splice roll 138 has one of its grooves 170 aligned with the blade 168, the controller 116 connects the vacuum ports 172 to a source of vacuum (not shown).

The controller 116 then commands a blade actuator 174 (as shown in FIG. 2) to extend the blade 168 into the slot 170 in the splice roll 138, as shown in FIG. 7, to sever the web 118 and form the tail end 162 of the first web 118.

As shown in FIG. 8, after the web 118 is severed, the blade actuator 174 retracts the blade 168 and the splice roll drive motor 148 begins to rotate the splice roll 138 about the splice roll axis 143 in a direction opposite the direction of rotation of the splice roll 138 when web material is being fed past the splice roll 138 to the web path 124. As the splice roll 138 rotates, with vacuum applied to the ports 172 in the periphery 142 of the splice roll, a portion of the first web 118 adjacent the tail end 162 of the first web 118 is held to the outer periphery 142 of the splice roll 138. As shown in FIG. 9, as the splice roll 138 continues to be driven in the direction opposite to the out-feed direction about the splice roll axis 143, a length of the first web 118 adjacent the tail end 162 of the first web 118 is drawn back out of the festoon arrangement 112 and is wound around the periphery 142 of the splice roll 138.

Figure 16:
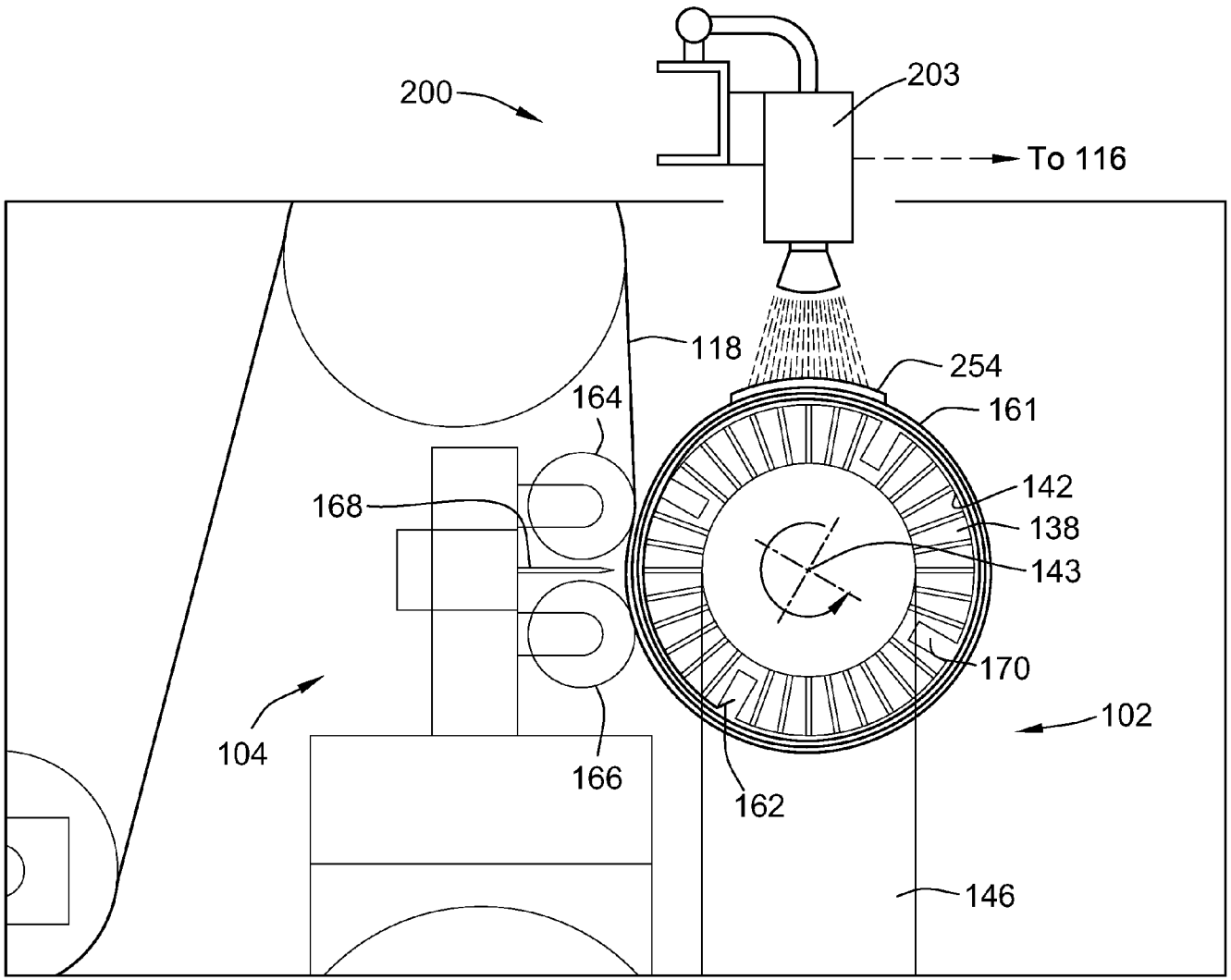
FIG. 16 is an enlarged schematic view of a portion of a second exemplary embodiment of an automated unwind stand, according to the invention, showing the manner in which a sprayer arrangement is utilized to apply a pattern of pressure-sensitive adhesive onto an inner surface of the tail end of the first web, for forming a splice between the first and second webs.

As shown in FIG. 16, after the first web 118 is severed, with the splice roll locked against rotation about the splice roll axis 143, the controller 116 commands the automated sprayer arrangement 203 to apply a pattern 254 of pressure-sensitive onto an inner surface 161 of the portion of the first web 118 wound about the periphery 142 of the splice roll 138 adjacent to and downstream from the tail end 162 of the first web 118.

Additionally, once the first web 118 is severed, the controller 116 commands of the spent coil ejection arrangement 108 to eject the remainder of the first coil 132 from the unwind axis 130, in the manner illustrated in FIG. 10. As shown in FIGS. 11 and 12, the frame 114 includes a pair of rails 178 so that the remainder of the first coil 132 can be readily rolled-away from the unwind axis 130 a sufficient distance to allow the second coil 134 to be mounted for rotation about the unwind axis 130. Lowering of the second coil 134 into position is accomplished by the controller 116 commanding actuators 180, 182 (see FIG. 2) of the spent coil handling arrangement 110 to first lower the second coil 134 into position at the unwind axis 130, as shown in FIG. 11, and then release the second coil 134 and retract toward the staging position shown in FIG. 3, in the manner indicated in FIG. 12. As also indicated in FIGS. 11 and 12, during the splicing and roll change operations, in the exemplary embodiment of the unwind stand 100, the festoon 112 continues to supply a continuous feed of the first web 118 along the web path 124.

Figure 17:
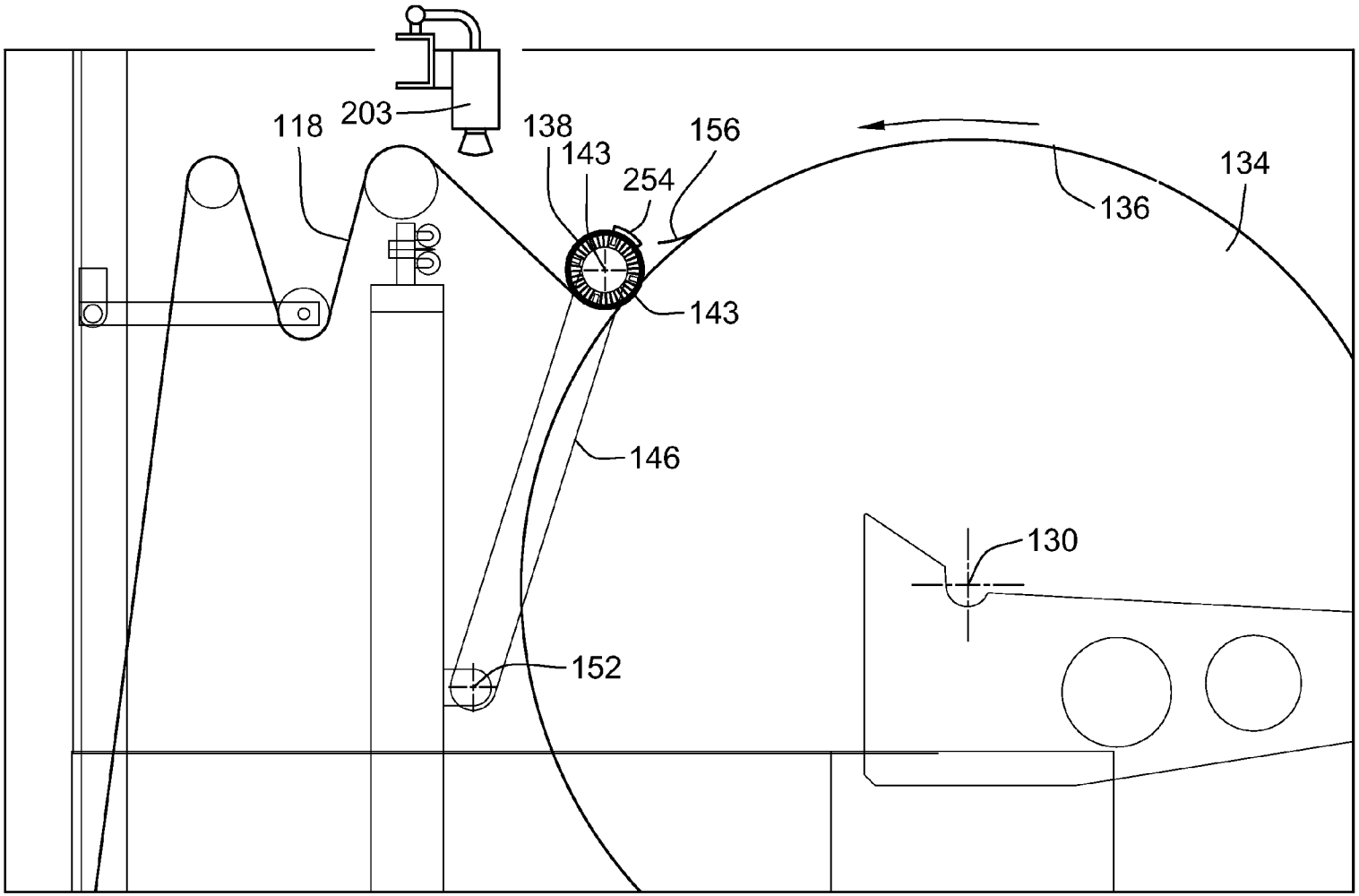
FIGS. 17-19 are sequential schematic illustrations of the manner of forming a splice between a tail end of a first web and a lead end of a second web of material, utilizing a splicing arrangement and a coil drive arrangement of the second exemplary embodiment of the unwind stand of FIG. 1, as modified by the addition of the adhesive sprayer arrangement of FIG. 16.

As indicated in FIG. 17, once the second coil 134 has been positioned at the unwind axis 130, the coil drive arrangement 106 may be utilized for orienting the lead end 156 of the second coil 134 at an advantageous angular location about the unwind axis 130. Specifically, with reference to FIGS. 2, 12 and 15, the coil drive arrangement 106 of the both exemplary embodiments of the unwind stands 100, 200 includes an endless belt 184 running around a series of pulleys and driven by a coil drive motor 186. As illustrated in FIG. 12, the coil drive arrangement 106 includes a drive belt festoon arrangement 188 which is configured in such a manner that the endless belt 184 of the coil drive arrangement is pulled into contact with the outer surface of a coil of material mounted at the unwind axis, regardless of the diameter of the coil of material (for example 132 or 134) resting in the endless drive belt 84.

As shown in FIG. 13, once the second coil 134 is mounted for rotation about the unwind axis 130 with the tail end 156 of the second coil 134 oriented at a desired location, and the sprayer arrangement 203 has deposited the pattern 254 of pressure-sensitive adhesive on the inner surface 161 of the first web 118 adjacent the tail end 162 of the first web 118, the controller 116 commands the articulated member drive motor 150 to pivot the articulating member 146 about its axis 152, with the splice roll 138 still locked against rotation about the splice roll axis 143, to thereby cause translating motion of the splice roll axis 143 with respect to the unwind axis 130 in such a manner that the portion of the first web 118 wrapped about the periphery 142 of the splice roll 138 is brought into close proximity with the outer surface of the second coil 134, with the adhesive pattern 254 positioned to be rolled onto the outside surface 192 of the second web 136.

In the exemplary embodiment of the unwind stand 100, it is contemplated that the articulated member drive motor 150 is capable of operation alternatively in a positioning mode or in a torque mode. During the initial stages of translation of the axis 143 of the splice roll 138 it is contemplated that the articulated member drive motor 150 would be driven in a positioning mode to place the outer periphery 142 of the splice roll adjacent to the second coil 134 in a position where the portion of the first web 118 wound about the splice roll 138 is not quite in contact with the outer surface of the second coil 134. The controller 116 will then command the articulated member drive motor 150 to operate in a torque mode and urge the splice roll 138 to pinch the portion of the first web 118 wound about the periphery of the splice roll 138 against the outer surface of the second coil 134 with sufficient force to cause adhesion of the lead end 156 of the second web 136 with the pattern 254 of pressure-sensitive adhesive adjacent the tail end 162 of the first web 118 to form a splice 294.

Figure 18:
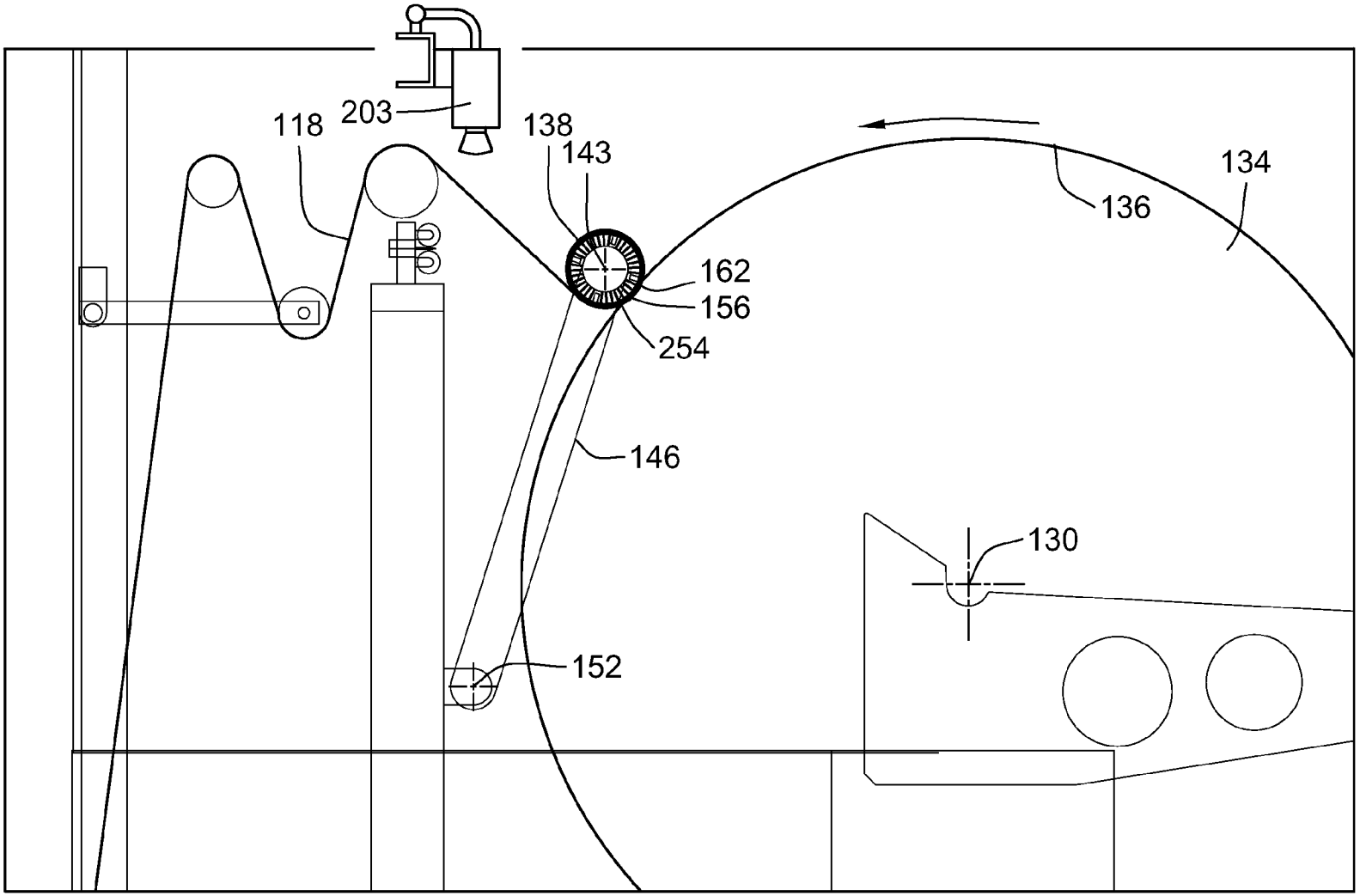
Figure 19:
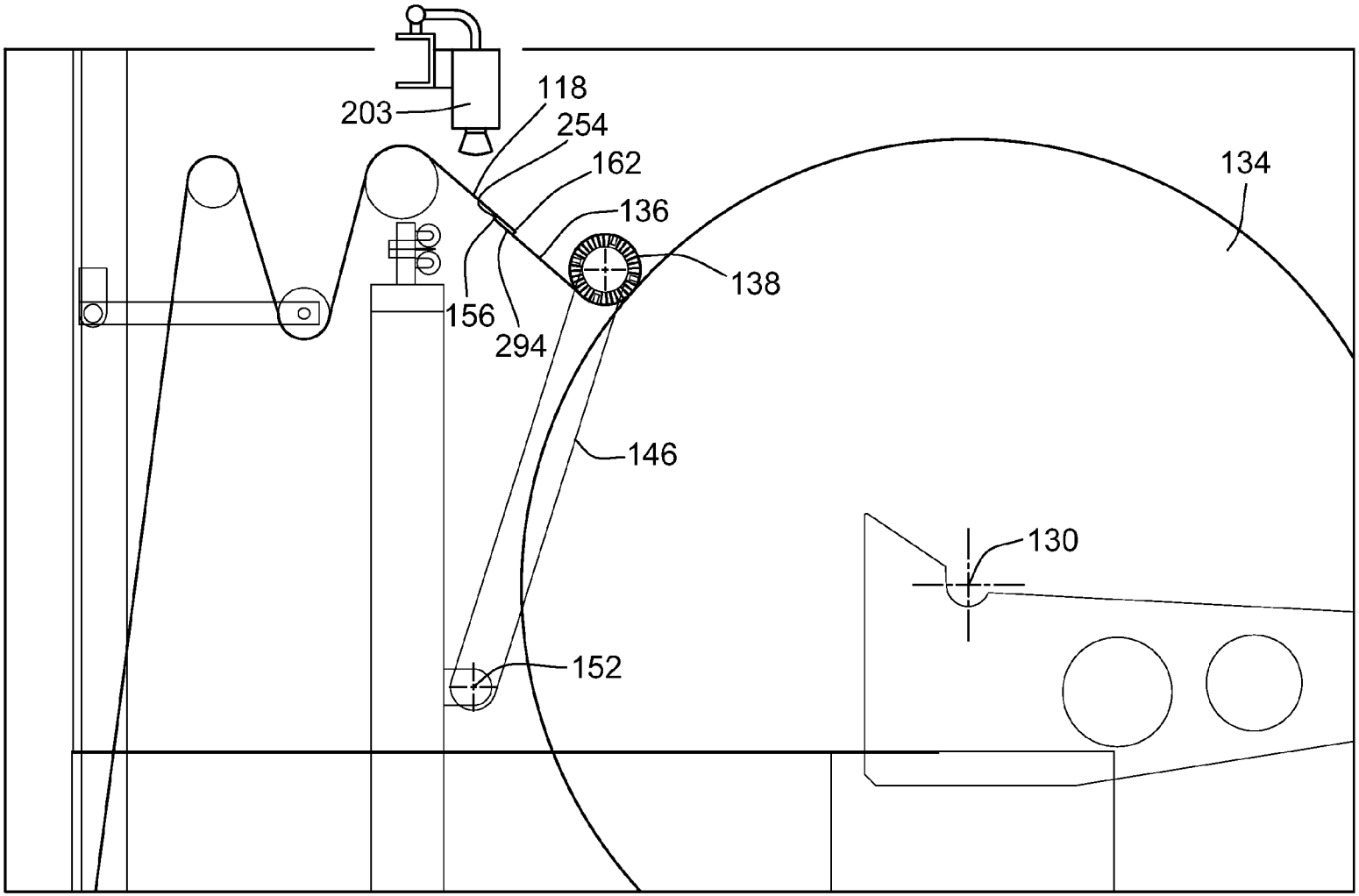

As shown in FIGS. 17-19, the controller 116 then commands the coil drive arrangement 106 to begin rotating the second coil 134 in the unwind direction, while the splice roll 138 is being urged against the second coil 134 by operation of the articulated member drive motor 150 in the torque mode, and the splice roll 138 is allowed to rotate about the splice roll axis 143. The splice roll drive motor 148 may also be utilized during this step in the process for driving the splice roll in a direction opposite to the unwind direction of the second coil 134.

As illustrated sequentially in FIGS. 17-19, rotation of the second coil 134 and splice roll 138 about the unwind axis and the splice roll axis 143 respectively causes the pattern 254 of pressure-sensitive adhesive adjacent the tail end 162 of the first web 118 to travel between the splice roll 138 and the second coil 134, as the portion of the first web 118 wound about the periphery of the splice roll 138 is unwound onto the surface of the second coil 134. As the pattern 254 of pressure-sensitive adhesive adjacent the tail end 162 of the first web 118 travels between the splice roll 138 and the outer surface 192 of the second coil 134, the adhesive pattern 254 is compressed between the inner surface 190 of the first web 118 and the outer surface 192 of the second web 136 in such a manner that the splice 294 is formed between the tail end 162 of the first web 118 and the lead end 156 of the second web 136, as illustrated in FIG. 19.

Once the splice 294 has been successfully formed, the controller 116 will initiate return of the unwind stand to the condition substantially as shown in FIG. 3, whereat the festoon 112 is no longer stowing a length of web, and the speed of feeding web along the web path 124 can be increased back to normal operating speed if it was decreased during the auto-splice and roll-change operation.

It is believed that spraying a pattern of pressure sensitive adhesive onto one or both of the faying surfaces of the webs may provide several advantages over application of a strip of double-sided, pressure-sensitive adhesive tape, in practicing the invention. Spraying the adhesive directly onto the web, rather than using tape, may reduce the possibility that the tape can become lodged in downstream processing equipment, such as embossing rolls. Less labor is required to automatically spray on the adhesive than is required to install the strip of tape. It is also more likely that the splice can remain in the final product when the pressure-sensitive adhesive is sprayed on, rather than being applied as a tape, thereby reducing waste.

Those having skill in the art will recognize that the present invention provides a substantial improvement over prior arrangements and methods for performing splicing and roll change operations in unwind stands. It will be further recognized that, although the invention has been described herein with regard to exemplary embodiments of an automated unwind stand according to the invention, in other embodiments of the invention some or all of the aspects and elements described herein may be combined in a variety of other ways or utilized individually with efficacy.

For example, it is expressly noted that a splicing arrangement according to the invention may be utilized in a variety of other automated and manually operated embodiments. A splicing arrangement, according to the invention, may also be utilized with unwind stands in applications where it is permissible and/or desirable to stop feeding of the web during the splicing process.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A splicing arrangement for splicing a tail end of a first web, having an uncoiled section thereof extending in an out-feed direction along a web path from a coiled section thereof coiled in a winding direction opposite the out-feed direction about an unwind axis into a first coil, to a lead end of a second web coiled in the winding direction about the unwind axis into a second coil, wherein the webs define outer and inner surfaces thereof, and the outer surfaces of respective outer layers of the first and second webs of each of the first and second coils defines respective outer surfaces of each of the first and second coils, the splicing arrangement comprising, a splice roll and a splice roll drive arrangement:

the splice roll defining a periphery thereof and mounted for rotation about a splice roll axis oriented substantially parallel to the unwind axis, configured for winding a portion of the uncoiled section of the first web adjacent the tail end of first web about the periphery of the splice roll by attaching the outer surface of the portion of the uncoiled section adjacent the tail end of the first web to the splice roll and rotating the splice roll about the splice roll axis in a direction opposite the winding direction of the coils; and the splice roll drive arrangement operatively connected between the splice roll axis and the unwind axis for selectively translating the splice roll axis to urge the tail end of the first web wound around the periphery of the splice roll into rolling contact with the outer surface of the second coil and for pressing the tail end of the first web against the outer surface of the second coil when the second coil is mounted for rotation about the unwind axis, for joining the tail end of the first coil to the lead end of the second coil through compressing an adhesive between the inside surface of the tail end of the first coil and the outer surface of the second coil by urging the splice roll against the second coil while the second coil is rotating about the unwind axis in the unwind direction and the splice roll is rolling about the splice roll axis in a direction opposite to the unwind direction.

2. The splicing arrangement of claim 1, wherein, the splice roll drive arrangement selectively drives the splice roll about the splice roll axis in the direction opposite to the winding direction of the coils and also alternatively in the winding direction.

3. The splicing arrangement of claim 1, wherein:

the splice roll drive arrangement further comprises an articulated member having a proximal end and a distal end thereof;

the proximal end of the articulated member being mounted for pivotable motion about an articulated member axis extending substantially parallel to the unwind axis; and the splice roll being rotatably mounted to the distal end of the articulated member for rotation about the splice roll axis.

4. The splicing arrangement of claim 3, wherein, the splice roll drive arrangement is configured for pivotably moving the articulated member about the articulated member axis, for translating the splice roll axis with respect to the unwind axis.

5. The splicing arrangement of claim 4, wherein:

the splice roll drive arrangement is configured for pivotably moving the articulated member about the articulated member axis in first and second modes of pivotable motion;

the first mode of pivotable motion comprising pivoting the articulated member to place the splice roll in a desired position thereof with respect to the unwind axis; and the second mode of pivotable motion comprising urging the splice roll toward the outer surface of the second coil.

6. The splicing arrangement of claim 5, wherein, the splice roll drive arrangement is configured for rotatably driving the splice roll about the splice roll axis in the direction opposite to the unwind direction and also alternatively in the winding direction.

7. The splicing arrangement of claim 1, wherein, the splice roll further comprises vacuum elements for attaching the outer surface of the portion of the uncoiled section adjacent the tail end of the first web to the splice roll.

8. The splicing arrangement of claim 1, further configured for cooperatively interfacing with a cutting arrangement for severing the first web of material when the first web of material is brought into contact with the cutting arrangement by the splice roll.

9. The splicing arrangement of claim 8, wherein:

the cutting arrangement comprises a blade; and the splice roll further comprises one or more grooves therein for receiving the blade.

10. The splicing arrangement of claim 9, wherein, the cutting arrangement comprises a pair of nip rollers disposed on opposite sides of the blade, and the splice roll drive arrangement is configured for urging the splice roll into contact with the nip rollers.

11. The splicing arrangement of claim 9, wherein the splice roll drive arrangement is configured for selectively rotating the splice roll to an angular position with respect to the blade where one of the grooves in the splice roll is aligned to receive the blade, and for actuating the blade to sever the web.

12. A method for splicing a tail end of a first web, having an uncoiled section thereof extending in an out-feed direction along a web path from a coiled section thereof coiled in a winding direction opposite the out-feed direction about an unwind axis into a first coil, to a lead end of a second web coiled in the winding direction about the unwind axis into a second coil, wherein the webs define outer and inner surfaces thereof, and the outer surfaces of respective outer layers of the first and second webs of each of the first and second coils defines respective outer surfaces of each of the first and second coils, the method comprising:

winding a portion of the uncoiled section of the first web adjacent the tail end of first web about a splicing roll mounted for rotation about a splice roll axis oriented substantially parallel to the unwind axis, by attaching the outer surface of the portion of the uncoiled section adjacent the tail end of the first web to the splice roll and rotating the splicing roll about the splice roll axis in a direction opposite the winding direction of the coils, so that the inside surface of a portion of the tail end of the first web faces outward from the splice roll axis; and joining the tail end of the first coil to the lead end of the second coil through compressing an adhesive between the inside surface of the tail end of the first coil and the outer surface of the second coil by urging the splice roll against the second coil while the second coil is rotating about the unwind axis in the unwind direction and the splice roll is rolling about the splice roll axis in a direction opposite to the second coil.

13. The method of claim 12, further comprising, applying a pressure sensitive adhesive to at least one of the outside surface of the first coil upstream from the lead end of the first coil and the inside surface of second coil downstream from the tail end of the second coil in such a manner that the pressure sensitive adhesive will be compressed between the inside surface of the tail end of the first coil and the outer surface of the second coil.

14. The method of claim 13, further comprising, applying the pressure sensitive adhesive in the form of a double-sided tape.

15. The method of claim 13, further comprising, applying the pressure sensitive adhesive by spraying an adhesive pattern of the pressure sensitive adhesive onto at least one of the outside surface of the first coil upstream from the lead end of the first coil and the inside surface of second coil downstream from the tail end of the second coil.

16. The method of claim 13, further comprising, orienting the second coil about the unwind axis to place the lead end of the second web in a predetermined pre-splicing position about the unwind axis.

17. The method of claim 13, further comprising, orienting the splice roll about the splice roll axis to place the tail end of the first coil in predetermined pre-splicing position about the splice roll axis.

18. The method of claim 12, further comprising, pulling the portion of the uncoiled section wound about the splice roll back along the web path in a direction opposite to the out-feed direction by rotating the splicing roll about the splice roll axis in the direction opposite the winding direction of the coils about the unwind axis.

19. The method of claim 18, further comprising, continuing to feed the uncoiled section of the first web along the web path in the out-feed direction while splicing the tail end of the first web to the lead end of the second web.

20. The method of claim 19, further comprising, reducing an out-feed speed of feeding the uncoiled section in the out-feed direction along the web path while splicing the tail end of the first web to the lead end of the second web.

21. The method of claim 20, further comprising, accumulating a stored portion of the uncoiled section of the first web along the web path prior to severing the uncoiled section of the first web.

22. The method of claim 18, further comprising, accumulating a stored portion of the uncoiled section of the first web along the web path prior to severing the uncoiled section of the first web, and pulling part of the stored portion of the uncoiled section back along the web path while winding the portion of the uncoiled section about the splice roll.

23. The method of claim 12, further comprising, bringing the splice roll into contact with the outer surface of the uncoiled section of the first web while the uncoiled section is attached to the coiled section of the first web, and severing the uncoiled section to form the tail end of the first web.

24. The method of claim 23, further comprising, prior to severing the uncoiled section, deflecting the uncoiled section from a running path thereof to a cutting position thereof through movement of the splice roll axis while the splice roll is bearing against the outer surface of the uncoiled section.

25. The method of claim 23, further comprising, rotating the splice roll into a predetermined cutting position prior to severing the first web.

26. The method of claim 25, further comprising, rotating the splice roll a predetermined distance about the splice roll axis after severing the first web.

27. The method of claim 12, further comprising, performing at least a portion of the method in an automated process wherein performing at least one step of the method automatically initiates at least a second step of the method according to a predetermined sequence of steps.

28. The method of claim 27, wherein, the first and second steps are selected from the list of steps consisting of:

mounting the first coil on the unwind axis;

feeding the uncoiled length of the first coil along the web path;

bringing the splice roll into contact with the outer surface of the uncoiled section first web while the uncoiled section is attached to the coiled section of the first web, and severing the uncoiled section to form the tail end of the first web;

prior to severing the uncoiled section, deflecting the uncoiled section from a running path thereof to a cutting position thereof through movement of the splice roll axis while the splice roll is bearing against the outer surface of the uncoiled section;

rotating the splice roll into a predetermined cutting position prior to severing the first web;

attaching the uncoiled section of the first web to the splice roll prior to severing the first web;

rotating the splice roll a predetermined distance about the splice roll axis after severing the first web;

accumulating a stored portion of the uncoiled section of the first web along the web path prior to severing the uncoiled section of the first web;

pulling part of the stored portion of the uncoiled section back along the web path while winding the portion of the uncoiled section about the splice roll;

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis;

applying a pressure sensitive adhesive to at least one of the outside surface of the first coil upstream from the lead end of the first coil and the inside surface of second coil downstream from the tail end of the second coil in such a manner that the pressure sensitive adhesive will be compressed between the inside surface of the tail end of the first coil and the outer surface of the second coil;

continuing to feed the uncoiled section of the first web along the web path in the out-feed direction while splicing the tail end of the first web to the lead end of the second web; and reducing an out-feed speed of feeding the uncoiled section in the out-feed direction along the web path while splicing the tail end of the first web to the lead end of the second web.

29. The method of claim 12, wherein, winding a portion of the uncoiled section of the first web adjacent the tail end of first web about a splicing roll further comprises the steps of:

bringing the splice roll into contact with the outer surface of the uncoiled section first web while the uncoiled section is attached to the coiled section of the first web, and severing the uncoiled section to form the tail end of the first web;

prior to severing the uncoiled section, deflecting the uncoiled section from a running path thereof to a cutting position thereof through movement of the splice roll axis while the splice roll is bearing against the outer surface of the uncoiled section;

rotating the splice roll into a predetermined cutting position prior to severing the first web;

attaching the uncoiled section of the first web to the splice roll prior to severing the first web;

rotating the splice roll a predetermined distance about the splice roll axis after severing the first web;

accumulating a stored portion of the uncoiled section of the first web along the web path prior to severing the uncoiled section of the first web; and pulling part of the stored portion of the uncoiled section back along the web path while winding the portion of the uncoiled section about the splice roll.

30. The method of claim 29, wherein, joining the tail end of the first coil to the lead end of the second coil further comprises the steps of:

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis; and applying a pressure sensitive adhesive to at least one of the outside surface of the first coil upstream from the lead end of the first coil and the inside surface of second coil downstream from the tail end of the second coil in such a manner that the pressure sensitive adhesive will be compressed between the inside surface of the tail end of the first coil and the outer surface of the second coil.

31. The method of claim 30, further comprising, continuing to feed the uncoiled section of the first web along the web path in the out-feed direction while splicing the tail end of the first web to the lead end of the second web.

32. The method of claim 31, further comprising, reducing an out-feed speed of feeding the uncoiled section in the out-feed direction along the web path while splicing the tail end of the first web to the lead end of the second web.

33. The method of claim 12, wherein, joining the tail end of the first coil to the lead end of the second coil further comprises the steps of:

removing the first coil from the unwind axis after severing the uncoiled section thereof, and mounting the second coil on the unwind axis with the lead end of the second web oriented toward the web path;

orienting the second coil about the unwind axis to place the lead end of the second web in a predetermined pre-splicing position about the unwind axis; and applying a pressure sensitive adhesive to at least one of the outside surface of the first coil upstream from the lead end of the first coil and the inside surface of second coil downstream from the tail end of the second coil in such a manner that the pressure sensitive adhesive will be compressed between the inside surface of the tail end of the first coil and the outer surface of the second coil.

34. The method of claim 33, further comprising, continuing to feed the uncoiled section of the first web along the web path in the out-feed direction while splicing the tail end of the first web to the lead end of the second web.

35. The method of claim 34, further comprising, reducing an out-feed speed of feeding the uncoiled section in the out-feed direction along the web path while splicing the tail end of the first web to the lead end of the second web.

36. An apparatus for splicing a tail end of a first web, having an uncoiled section thereof extending in an out-feed direction along a web path from a coiled section thereof coiled in a winding direction opposite the out-feed direction about an unwind axis into a first coil, to a lead end of a second web coiled in the winding direction about the unwind axis into a second coil, wherein the webs define outer and inner surfaces thereof, and the outer surfaces of respective outer layers of the first and second webs of each of the first and second coils defines respective outer surfaces of each of the first and second coils, the apparatus comprising:

a splicing arrangement having a splice roll and a splice roll drive arrangement;

the splice roll defining a periphery thereof and mounted for rotation about a splice roll axis oriented substantially parallel to the unwind axis, configured for winding a portion of the uncoiled section of the first web adjacent the tail end of first web about the periphery of the splice roll by attaching the outer surface of the portion of the uncoiled section adjacent the tail end of the first web to the splice roll and rotating the splice roll about the splice roll axis in a direction opposite the winding direction of the coils; and the splice roll drive arrangement operatively connected between the splice roll axis and the unwind axis for selectively translating the splice roll axis to urge the tail end of the first web wound around the periphery of the splice roll into rolling contact with the outer surface of the second coil and for pressing the tail end of the first web against the outer surface of the second coil when the second coil is mounted for rotation about the unwind axis, for joining the tail end of the first coil to the lead end of the second coil through compressing an adhesive between the inside surface of the tail end of the first coil and the outer surface of the second coil by urging the splice roll against the second coil while the second coil is rotating about the unwind axis in the unwind direction and the splice roll is rolling about the splice roll axis in a direction opposite to the unwind direction.

37. The apparatus of claim 36, further comprising, a coil drive arrangement for receiving the second coil and driving the second coil in the unwind direction about the unwind axis.

38. The apparatus of claim 36, further comprising, an adhesive application arrangement, for applying a pressure sensitive adhesive to at least one of the outside surface of the first coil upstream from the lead end of the first coil and the inside surface of second coil downstream from the tail end of the second coil in such a manner that the pressure sensitive adhesive will be compressed between the inside surface of the tail end of the first coil and the outer surface of the second coil.

39. The apparatus of claim 38, wherein the adhesive application arrangement further comprises, an arrangement for applying the pressure sensitive adhesive in the form of a double-sided tape.

40. The apparatus of claim 38, wherein the adhesive application arrangement further comprises, an arrangement for applying the pressure sensitive adhesive by spraying an adhesive pattern of the pressure sensitive adhesive onto at least one of the outside surface of the first coil upstream from the lead end of the first coil and the inside surface of second coil downstream from the tail end of the second coil.

41. The apparatus of claim 36, further comprising, an accumulator arrangement for accumulating a stored portion of the uncoiled section of the first web along the web path prior to severing the uncoiled section of the first web.

42. The apparatus of claim 41, wherein, the accumulator arrangement comprises a festoon arrangement.

43. The apparatus of claim 36, wherein, the splice roll drive arrangement selectively drives the splice roll about the splice roll axis in the direction opposite to the winding direction of the coils and alternatively also in the winding direction.

44. The apparatus of claim 36, wherein:

the splice roll drive arrangement further comprises an articulated member having a proximal end and a distal end thereof;

the proximal end of the articulated member being mounted for pivotable motion about an articulated member axis extending substantially parallel to the unwind axis; and the splice roll being rotatably mounted to the distal end of the articulated member for rotation about the splice roll axis.

45. The apparatus of claim 36, wherein, the splice roll further comprises vacuum elements for attaching the outer surface of the portion of the uncoiled section adjacent the tail end of the first web to the splice roll.

46. The apparatus of claim 36, further comprising a cutting arrangement for severing the first web of material when the first web of material is brought into contact with the cutting arrangement by the splice roll.

47. The apparatus of claim 46, wherein:

the cutting arrangement comprises a blade; and the splice roll further comprises one or more grooves therein for receiving the blade.

48. The apparatus of claim 47, further comprising, a controller operatively connected between the cutting arrangement and the splice roll drive arrangement for rotating the splice roll to an angular position with respect to the blade whereat one of the grooves in the splice roll is aligned to receive the blade, and for actuating the blade to sever the web.

49. The apparatus of claim 48, wherein, the splice roll further comprises vacuum elements for attaching the outer surface of the portion of the uncoiled section adjacent the tail end of the first web to the splice roll, and the controller is operatively connected for selectively applying vacuum to the vacuum elements.

50. The apparatus of claim 36, further comprising, a controller operatively connected for controlling translation of the splice roll.

51. A computer readable medium having stored thereupon instructions for implementing a method for splicing a tail end of a first web, having an uncoiled section thereof extending in an out-feed direction along a web path from a coiled section thereof coiled in a winding direction opposite the out-feed direction about an unwind axis into a first coil, to a lead end of a second web coiled in the winding direction about the unwind axis into a second coil, wherein the webs define outer and inner surfaces thereof, and the outer surfaces of respective outer layers of the first and second webs of each of the first and second coils defines respective outer surfaces of each of the first and second coils, wherein the method comprises:

winding a portion of the uncoiled section of the first web adjacent the tail end of first web, about a splicing roll mounted for rotation about a splice roll axis oriented substantially parallel to the unwind axis, by attaching the outer surface of the portion of the uncoiled section adjacent the tail end of the first web to the splice roll and rotating the splicing roll about the splice roll axis in a direction opposite the winding direction of the coils, so that the inside surface of a portion of the tail end of the first web faces outward from the splice roll axis; and joining the tail end of the first coil to the lead end of the second coil through compressing an adhesive between the inside surface of the tail end of the first coil and the outer surface of the second coil by urging the splice roll against the second coil while the second coil is rotating about the unwind axis in the unwind direction and the splice roll is rolling about the splice roll axis in a direction opposite to the second coil.

* * * * *